US008181952B2

(12) United States Patent
Hamasaki et al.

(10) Patent No.: US 8,181,952 B2
(45) Date of Patent: May 22, 2012

(54) PAPER SHEET HANDLING MECHANISM AND METHOD FOR HANDLING PAPER SHEETS

(75) Inventors: Hiroki Hamasaki, Himeji (JP); Tetsuya Taniguchi, Himeji (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 194 days.

(21) Appl. No.: 12/733,647

(22) PCT Filed: Feb. 12, 2008

(86) PCT No.: PCT/JP2008/052244

§ 371 (c)(1),
(2), (4) Date: Mar. 11, 2010

(87) PCT Pub. No.: WO2009/034722

PCT Pub. Date: Mar. 19, 2009

(65) Prior Publication Data

US 2010/0219580 A1 Sep. 2, 2010

(30) Foreign Application Priority Data

Sep. 14, 2007 (WO) ..... PCT/JP2007/067967

(51) Int. Cl.
*B65H 83/00* (2006.01)

(52) U.S. Cl. ..... 271/3.21; 271/276; 271/198; 271/306

(58) Field of Classification Search ..... 271/3.14, 271/3.21, 276, 198, 303, 306; 270/52.04, 270/60; 414/789.9
See application file for complete search history.

(56) References Cited

U.S. PATENT DOCUMENTS

| | | | | |
|---|---|---|---|---|
| 4,025,420 | A | 5/1977 | Horino | |
| 5,735,516 | A * | 4/1998 | Gerlier et al. | 270/60 |
| 6,019,209 | A | 2/2000 | Hara et al. | |
| 2003/0075487 | A1 | 4/2003 | Abe et al. | |

FOREIGN PATENT DOCUMENTS

| | | |
|---|---|---|
| JP | 58-108578 | 7/1983 |
| JP | 06-032514 | 2/1994 |
| JP | 10-508962 | 9/1998 |
| WO | WO 96/15511 | 5/1996 |

OTHER PUBLICATIONS

European Supplementary Search Report (dated Mar. 30, 2011—7 pages).

* cited by examiner

*Primary Examiner* — Michael McCullough
(74) *Attorney, Agent, or Firm* — Renner, Kenner, Greive, Bobak, Taylor & Weber

(57) ABSTRACT

A paper sheet handling mechanism and method includes a loop-shaped part configured to hold a paper sheet (W1). Once a paper sheet (W2) present on the upstream side of a transport path relative to the loop-shaped part is fed to the loop-shaped part, the paper sheet (W2) present on the upstream side and the paper sheet (W1) present on the loop-shaped part are respectively moved, such that the paper sheet (W2) can be stacked with paper sheet (W1) circulated along the loop-shaped part. A paper sheet length detector determines whether the length of the paper sheet (W2) in the transport direction, which is fed to the loop-shaped part from the upstream side relative to the loop-shaped part along the transport path, is longer than a predetermined length. If the length is longer than the predetermined length, the paper sheet (W2) is ejected from the loop-shaped part.

6 Claims, 9 Drawing Sheets

PAPER SHEET HANDLING MECHANISM AND METHOD FOR HANDLING PAPER SHEETS

FIELD OF THE INVENTION

The present invention relates to a paper sheet handling mechanism and a method for handling paper sheets, wherein this mechanism and/or method can eject a plurality of paper sheets, such as banknotes, checks or the like, respectively having different lengths, in a batch form, with specified positions of such paper sheets aligned with one another.

BACKGROUND OF THE INVENTION

In the past, various paper sheet handling machines, each adapted for storing therein the paper sheets, such as banknotes, checks or the like, have been commonly known. In this paper sheet handling machine, such paper sheets taken in the machine via a take-in slot are returned via a return slot, when a command for cancelling the storage of the paper sheets is inputted by, for example, a host machine, a user or the like.

In the case the user once stores the plurality of paper sheets, respectively having substantially different lengths, into the paper sheet handling machine, and then the user inputs the command for cancelling the storage of the paper sheets to the machine, such as by pushing down a button for cancelling the storage, after the paper sheets are taken in the machine via the take-in slot, it is desirable that such paper sheets, respectively having substantially different lengths, can be returned, collectively in the batch form, via the return slot, when the storage is cancelled.

DISCLOSURE OF THE INVENTION

For instance, JP2003-157461A discloses the banknote handling machine, which can recognize whether or not the banknotes taken in the machine via an inlet can be deposited into the machine, by using a recognition unit, and then return ejected banknotes that are judged, as the banknotes not to be deposited into the machine, by the recognition unit, collectively in the batch form, via the return slot. However, this banknote handling machine cannot align certain ends of the respective banknotes with one another, when the machine returns various banknotes, respectively having different lengths, collectively in the batch form, via the return slot. Therefore, there is a risk that the user cannot well grasp or hold some banknotes, respectively having a relatively short length or lengths, in the batch of banknotes, and thus may tend to inadvertently drop such short banknotes, when taking out the batch of banknotes via the return slot. Besides, such a batch of banknotes generally shows undesirable appearance.

Further, JP2004-149264A discloses a stacking unit which can securely stack therein various banknotes, respectively having different sizes, while aligning rear ends in the take-in direction of the banknotes with one another. However, in this stacking unit, it is necessary to know or detect in advance each length of the banknotes to be stacked therein. Additionally, in the case the banknotes, respectively having different lengths, are stacked successively in the stacking unit, it is necessary to move or set each component of the stacking unit, depending on each length of the banknotes, every time the length of the banknotes is changed. This makes it rather difficult to rapidly perform the stacking operation for such banknotes.

Furthermore, U.S. Pat. No. 6,273,413 discloses another paper sheet handling machine, wherein a first transport path is joined to a second transport path at a middle part (or confluence point) of the first transport path, and wherein a first sensor is provided to the first transport path, while a second sensor is provided to the second transport path, whereby one paper sheet or a batch of paper sheets transported by the first transport path can be joined to one new paper sheet transported by the second transport path at the confluence point, based on detection information obtained by the respective sensors, so that these paper sheets can be stacked one on another, while being arranged into a new batch. However, in this paper sheet handling machine, it is necessary to reciprocate the paper sheets stacked in the batch form, across the confluence point, along the first transport path, every time the new paper sheet is stacked with the stacked paper sheets. Therefore, it takes unduly much time to stack the paper sheets into a desired batch. Besides, it is necessary to ensure a considerably wide space required for reciprocating the paper sheets stacked in the batch form, resulting in an unduly large-sized paper sheet handling machine. Further, in this case, the batch of the paper sheets should be stopped in a position in which the first sensor is located. However, if the batch of the paper sheets is transported at a relatively high speed, the stop position may tend to be rather shifted, resulting in a markedly irregular line of ends of the respective paper sheets stacked in the batch form. Contrarily, if the batch of the paper sheets is transported at a relatively low speed, the shift of the stop position can be well mitigated. However, such a low-speed operation should require unduly much time. Accordingly, this paper sheet handling machine is not applicable or suitable for rapidly stacking the paper sheets that are transported successively one by one, because of the marked positional shift of the respective ends of the paper sheets caused by the reciprocating operation for stacking the paper sheets.

In addition, JP2000-11238A discloses a banknote dispensing machine provided with a winding type storage unit. This banknote dispensing machine can securely store therein and feed out therefrom the plurality of paper sheets, respectively having different lengths, one by one. However, when dispensing the banknotes, this machine cannot dispense the banknotes, in the batch form, with the ends of the respective banknotes aligned with one another.

Further, JP51-161892U discloses a paper sheet accumulation machine adapted for accumulating the plurality of paper sheets by grasping or holding the paper sheets between a cylindrical rotary drum and a belt. However, this JP51-161892U does not refer to anything about the ejection of the plurality of paper sheets, respectively having different lengths, in the batch form, with leading ends or rear ends thereof aligned with one another. Additionally, in this paper sheet accumulation machine disclosed in JP51-161892U, if the paper sheet, having a length longer than the length that can be held by the rotary drum, is fed to the paper sheet accumulation machine, such a paper sheet cannot be held in this accumulation machine. However, this JP51-161892U is silent about such a problem as well as about any method for solving this problem.

JP2552995B discloses a paper sheet handling machine, wherein a loop-shaped endless belt is provided over a plurality of rollers and pulleys, and wherein a guide belt is provided along an outer circumferential face of the endless belt, whereby the plurality of paper sheets can be grasped or held between the endless belt and the guide belt. However, this JP2552995B does not refer to anything about the ejection of the plurality of paper sheets, respectively having different lengths, in the batch form, with the leading ends or rear ends thereof aligned with one another. Additionally, in this paper sheet handling machine disclosed in JP2552995B, if the paper sheet, having length, longer than the length that can be held between the endless belt and the guide belt, is fed to the paper sheet handling machine, such a paper sheet cannot be ejected from a holding space between the endless belt and the guide belt. However, this JP2552995B is silent about such a problem as well as about a method for solving this problem.

The present invention was made in light of the above problems. Therefore, it is an object of this invention to provide a paper sheet handling mechanism and a method for handling the paper sheets, which can eject the paper sheets without holding the paper sheets by a loop-shaped part, in the case the paper sheet, having the length larger than a predetermined length, e.g., the paper sheet, having the length larger than the length that can be held by the loop-shaped part of the transport path, is fed to the loop-shaped part.

A paper sheet handling mechanism of the present invention, comprising: a transport path having a loop-shaped part provided in the middle part thereof, the downstream side including at least the loop-shaped part of the transport path being capable of transporting a plurality of paper sheets; a driving unit configured to move the paper sheets along the transport path, such that the paper sheets, respectively present on the upstream side relative to the loop-shaped part as well as on the loop shaped part, can be transported, independently of or in synchronism with, one another; a paper sheet length detector provided to the loop-shaped part and/or upstream side relative to the loop-shaped part along the transport path and configured to detect whether or not the length in the transport direction of the paper sheet fed to the loop-shaped part from the upstream side relative to the loop-shaped part along the transport path is longer than a predetermined length; and a control unit configured to control the driving unit to move each of the paper sheets present on the upstream side relative to the loop-shaped part and one paper sheet or a batch of paper sheets present on the loop-shaped part, such that once the paper sheet present on the upstream side relative to the loop-shaped part is fed to the loop-shaped part, this paper sheet present on the upstream side relative to the loop-shaped part can be stacked with the one paper sheet or the batch of paper sheets circulated along the loop-shaped part, and when the paper sheet length detector detects that the length in the transport direction of the paper sheet fed to the loop-shaped part from the upstream side relative to the loop-shaped part is longer than the predetermined length, such a paper sheet will be ejected from the loop-shaped part.

According to the above paper sheet handling mechanism, with the provision of the paper sheet length detector, the length in the transport direction of the paper sheet fed to the loop-shaped part from the upstream side relative to the loop-shaped part along the transport path can be detected. If this length in the transport direction of the paper sheet is longer than the predetermined length, e.g., the length that can be held on the loop-shaped part, such a paper sheet will be ejected from the loop-shaped part. Therefore, even if the paper sheet, having the length longer than the predetermined length, e.g., the length longer than the length that can be held on the loop-shaped part, is fed to the loop-shaped part, such a paper sheet can be directly ejected, without being held by the loop-shaped part. If the paper sheet having the length longer than the length that can be held on the loop-shaped part is held, inadvertently or accidentally, by the loop-shaped part, such a longer paper sheet would be circulated along the loop-shaped part over substantially the whole circumferential face of the loop-shaped part, thus blocking the advancement of a diverter for ejecting the paper sheets from the loop-shaped part, into the loop-shaped part. As a result, the plurality of paper sheets held on the loop-shaped part cannot be ejected to the downstream side from the loop-shaped part. However, this problem can be securely solved by the paper sheet handling mechanism of the present invention, because the paper sheet having the length longer than the length that can be held on the loop-shaped part can be directly ejected, without being held by the loop-shaped part.

In the paper sheet handling mechanism of the present invention, it is preferable that in the case the one paper sheet or the batch of paper sheets are held on the loop-shaped part, and a paper sheet, whose length in the transport direction of the paper sheet is detected by the paper sheet length detector to be longer than the predetermined length, is fed to the loop-shaped part from the upstream side relative to the loop-shaped part, both the detected paper sheet and the one paper sheet or the batch of paper sheets held on the loop-shaped part will be ejected from the loop-shaped part, while the detected paper sheet is stacked with the one paper sheet or the batch of paper sheets held on the loop-shaped part.

In the paper sheet handling mechanism of the present invention, it is preferable that the paper sheet length detector includes an upstream-side paper sheet detector provided at a point on the upstream side relative to the loop-shaped part along the transport path, and a downstream-side paper sheet detector provided on the downstream side relative to the upstream-side paper sheet detector, at a point in the loop-shaped part or on the upstream side relative to the loop-shaped part along the transport path, the upstream-side paper sheet detector being spaced apart from the downstream-side paper sheet detector, by a distance corresponding to the predetermined length, and when the paper sheet is simultaneously detected by both the upstream-side paper sheet detector and downstream-side paper sheet detector along the transport path, the length in the transport direction of this paper sheet will be judged to be longer than the predetermined length.

In the paper sheet handling mechanism of the present invention, it is preferable that the paper sheet length detector includes an upstream-side paper sheet detector provided at a point on the upstream side relative to the loop-shaped part along the transport path, and a downstream-side paper sheet detector provided on the downstream side relative to the upstream-side paper sheet detector, at a point in the loop-shaped part or on the upstream side relative to the loop-shaped part along the transport path, the upstream-side paper sheet detector being spaced apart from the downstream-side paper sheet detector, by a distance shorter than the predetermined length, and in the case the paper sheet is once detected by both the upstream-side paper sheet detector and downstream-side paper sheet detector along the transport path, and then the paper sheet is continuously detected by the upstream-side paper sheet detector, even after the paper sheet is transported by a predetermined distance, the length in the transport direction of this paper sheet will be judged to be longer than the predetermined length.

In the paper sheet handling mechanism of the present invention, it is preferable that the paper sheet length detector includes a paper sheet detector provided at a point on the upstream side relative to the loop-shaped part along the transport path, when the paper sheet detector detects each of the leading end and rear end of the paper sheet to be fed to the loop-shaped part from the upstream side relative to the loop-shaped part along the transport path, the length in the transport direction of this paper can be detected, and if such a detected length is longer than the predetermined length, the length in the transport direction of this paper sheet will be judged to be longer than the predetermined length.

In the paper sheet handling mechanism of the present invention, it is preferable that the paper sheet length detector includes a paper sheet detector provided at a point on the upstream side relative to the loop-shaped part along the transport path, and in the case the leading end of the paper sheet to be fed to the loop-shaped part from the upstream side relative to the loop-shaped part along the transport path is once detected by the paper sheet detector, and then the paper sheet is continuously detected by the paper sheet detector, even after the paper sheet is transported by the predetermined length, the length in the transport direction of this paper sheet will be judged to be longer than the predetermined length.

A method for handling paper sheets of the present invention, comprising the steps of: transporting the paper sheets, successively one by one, at a point on the upstream side relative to a loop-shaped part along a transport path; detecting whether or not the length in the transport direction of the paper sheet fed to the loop-shaped part from the upstream side relative to the loop-shaped part along the transport path is longer than a predetermined length; holding the paper sheets by circulating them on the loop-shaped part of the transport path, in a batch form; and ejecting the paper sheets which are stacked in the batch form and circulated on the loop-shaped part, once the paper sheet present on the upstream side relative to the loop-shaped part is fed to the loop-shaped part, the paper sheet present on the upstream side relative to the loop-shaped part and one paper sheet or a batch of paper sheets present on the loop-shaped part are respectively moved, such that the paper sheet present on the upstream side relative to the loop-shaped part can be stacked with the one paper sheet or the batch of paper sheets circulated along the loop-shaped part, and when the length in the transport direction of the paper sheet fed to the loop-shaped part from the upstream side relative to the loop-shaped part is judged to be longer than the predetermined length, this paper sheet will be ejected from the loop-shaped part.

According to the above method for handling paper sheets, the length in the transport direction of the paper sheet fed to the loop-shaped part from the upstream side relative to the loop-shaped part along the transport path can be detected. If this length in the transport direction of the paper sheet is longer than the predetermined length, e.g., the length that can be held on the loop-shaped part, such a paper sheet will be ejected from the loop-shaped part. Therefore, even if the paper sheet, having the length longer than the predetermined length, e.g., the length longer than the length that can be held on the loop-shaped part, is fed to the loop-shaped part, such a paper sheet can be directly ejected, without being held by the loop-shaped part. If the paper sheet having the length longer than the length that can be held on the loop-shaped part is held, inadvertently or accidentally, by the loop-shaped part, such a longer paper sheet would be circulated along the loop-shaped part over substantially the whole circumferential face of the loop-shaped part, thus blocking the advancement of a diverter for ejecting the paper sheets from the loop-shaped part, into the loop-shaped part. As a result, the plurality of paper sheets held on the loop-shaped part cannot be ejected to the downstream side from the loop-shaped part. However, this problem can be securely solved by the method for handling paper sheets of the present invention, because the paper sheet having the length longer than the length that can be held on the loop-shaped part can be directly ejected, without being held by the loop-shaped part.

DETAILED DESCRIPTION OF THE INVENTION

Hereinafter, the paper sheet handling machine related to one exemplary embodiment of the present invention will be described with reference to the drawings. FIGS. 1 to 13 are provided for respectively illustrating the embodiment of the paper sheet handling machine of this invention.

First of all, general construction of the paper sheet handling machine of this embodiment will be described. Namely, the paper sheet handling machine of this embodiment is configured for feeding the paper sheets, respectively having different lengths, such as banknotes, checks or the like, to the interior of the machine, successively one by one, and recognizing whether or not the paper sheets fed to the interior of the machine are ejected paper sheets (such as unfit and/or counterfeit banknotes, unreadable banknotes and the like), then ejecting the ejected paper sheets to the exterior, while escrowing therein normal banknotes that are not ejected paper sheets and then feeding such normal banknotes to another machine located outside the paper sheet handling machine.

Figure 1:
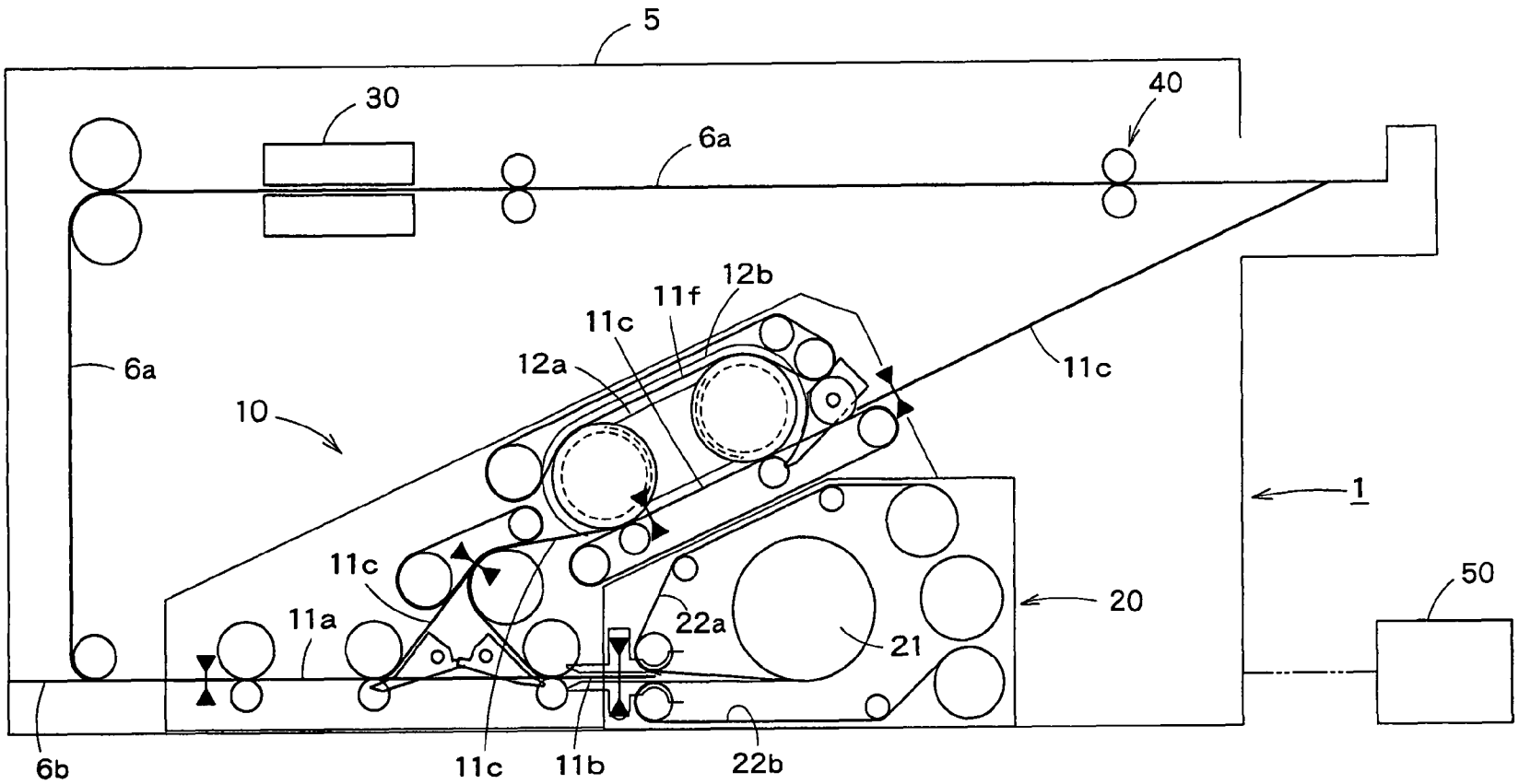
FIG. 1 is a schematic view illustrating construction of the paper sheet handling machine related to one embodiment of the present invention.

As shown in FIG. 1, the paper sheet handling machine 1 of this embodiment includes a casing 5, a paper sheet bunching unit 10, a paper sheet escrow unit 20, a paper sheet recognition unit 30 and a feeding unit 40 adapted for feeding the paper sheets, successively, one by one, into the casing 5. In this case, the respective units 10 to 40 are located in the casing 5, respectively. Further, the paper sheet handling machine 1 includes a control unit 50 adapted for controlling each of the paper sheet bunching unit 10, paper sheet escrow unit 20, feeding unit 40 and the like.

Now, each component of this paper sheet handling machine 1 will be described in more detail.

A transport path 6*a* adapted for transporting the paper sheets is also provided in the casing 5. As shown in FIG. 1, the transport path 6*a* is configured to transport the paper sheets fed out from the feeding unit 40. This transport unit 6*a* is connected with the paper sheet bunching unit 10 located in the casing 5. Further, as shown in FIG. 1, the transport path 6*a* is bifurcated on the way, wherein a bifurcated path 6*b* of the transport path 6*a* extends up to the exterior of the casing 5. With provision of such a bifurcated path 6*b*, the paper sheets escrowed in the paper sheet escrow unit 20 can be transported to another machine (e.g., a check storage machine located in an ATM, when the checks are used herein as the paper sheets) located outside the paper sheet handling machine 1.

The paper sheet recognition unit 30 is provided to the transport path 6*a*. This paper sheet recognition unit 30 can serve to recognize whether or not the paper sheets fed into the casing 5 by the feeding unit 40 are the ejected paper sheets (such as the unfit and/or counterfeit banknotes, unreadable banknotes and the like). In this case, each recognition result on the paper sheets obtained by the paper sheet recognition unit 30 is transmitted to the control unit 50.

Figure 2:
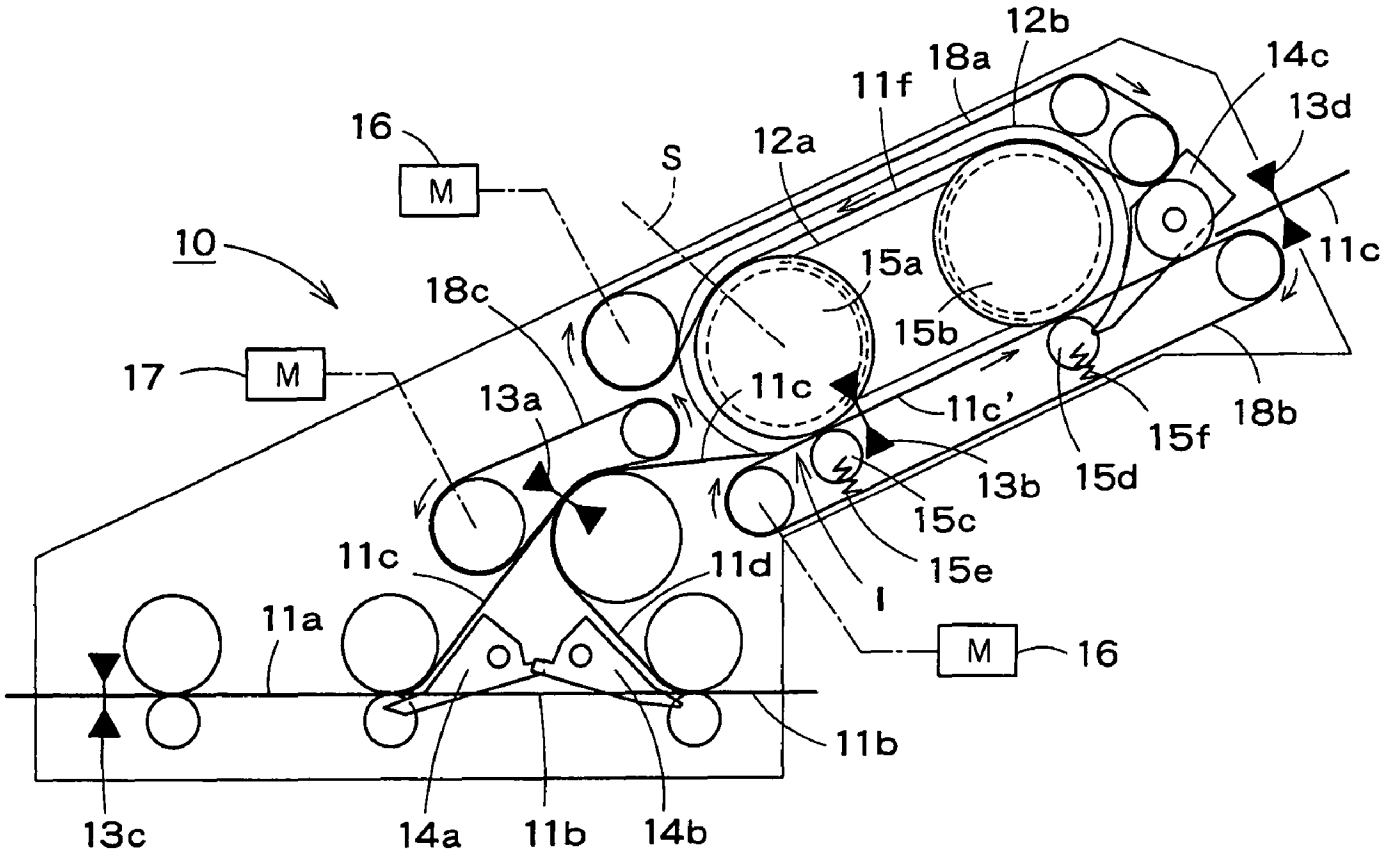
FIG. 2 is an enlarged view showing construction of a paper sheet bunching unit of the paper sheet handling machine shown in FIG. 1.

Next, referring to FIGS. 1 and 2, the construction of the paper sheet bunching unit 10 will be detailed. This paper sheet bunching unit 10 is configured to temporarily hold therein the ejected paper sheets, among the paper sheets fed into the casing 5 by the feeding unit 40, and then eject the ejected paper sheets, in the batch form, with the leading ends, rear ends or the like of such ejected paper sheets aligned with one another.

In the paper sheet bunching unit 10, a plurality of transport paths are provided for transporting the respective paper sheets. Specifically, a transport path 11*a* is connected with the aforementioned transport path 6*a*, wherein the paper sheets are transported from the transport path 6*a* to the transport path 11*a*. Further, the transport path 11*a* is branched into two transport paths 11*b*, 11*c*. The transport path 11*b* is connected with the paper sheet escrow unit 20 that will be described later.

Meanwhile, as shown in FIG. 1, the transport path 11*c* extends up to the exterior of the casing 5, and includes a loop-shaped transport path 11*f* provided in the middle part thereof. More specifically, as shown in FIG. 2, the loop-shaped part comprises a combination of a middle part 11*c*' of the transport path 11*c* and the transport path 11*f* that can serve as a returning transport section. In this case, the paper sheets are usually ejected to the exterior of the casing 5 from the transport path 11*c*. On the other hand, the paper sheets can be optionally circulated and held on the loop-shaped part comprising the middle part 11*c*' of the transport path 11*c* and the transport path 11*f*. In this manner, if the paper sheets are required to be stacked, in regard to the paper sheets fed to the transport path 11*c* from the transport path 11*a*, such paper sheets will be stacked, one on another, on the loop-shaped part comprising the middle part 11*c*' of the transport path 11*c* and the transport path 11*f*, while the resultant stacked paper sheets are successively circulated along the loop-shaped part. Thereafter, such stacked paper sheets will be ejected to the exterior of the casing 5 from the transport path 11*c*.

As shown in FIG. 2, a transport path 11*d* is branched from a middle point of the transport path 11*b* and connected with a middle point of the transport path 11*c*.

Paper sheet detection sensors 13*a* to 13*d*, each comprising a sensor, e.g., an optical sensor, and adapted for detecting each paper sheet transported along each transport path, are respectively provided to each transport path provided in the paper sheet bunching unit 10. Among them, the paper sheet detection sensor 13*a* is located on the upstream side relative to the loop-shaped part of the transport part 11*c*, while the paper sheet detection sensor 13*b* is located at the middle part

11*c*' of the transport path 11*c* constituting the loop-shaped part. The distance between the two paper sheet detection sensors 13*a* and 13*b* will be discussed later.

The paper sheet detection sensor 13*c* is provided to the transport path 11*a*. As shown in FIG. 2, the paper sheet detection sensor 13*d* is provided to the transport path 11*c* at an outlet of the paper sheet bunching unit 10. The detection results of these paper sheet detection sensors 13*a* to 13*d* are transmitted to the control unit 50, respectively.

At branch or diversion points of the respective transport paths in the paper sheet bunching unit 10, diverters 14*a* to 14*c* are provided, respectively, for diverting the paper sheets from one transport path to another transport path. More specifically, the diverter 14*a* is provided at the diversion point from the transport path 11*a* to the transport paths 11*b*, 11*c*. Namely, the diverter 14*a* can serve to divert the paper sheets fed from the transport path 11*a* to either one of the transport paths 11*b*, 11*c*. In addition, the diverter 14*b* is provided at the diversion point from a middle portion of the transport path 11*b* to the transport path 11*d*. With optional operation of this diverter 14*b*, the paper sheets fed from the transport path 11*b* can be further fed along the transport path 11*b* to the transport path 11*a* or diverted from the transport path 11*b* to the transport path 11*d*. Additionally, the diverter 14*c* is provided at the diversion point from the transport path 11*c* to the returning transport section of the transport path 11*f*. This diverter 14*c* can be optionally operated to allow the paper sheets to be ejected from the transport path 11*c* to the exterior of the casing 5, or otherwise allow the paper sheets to be held on the loop-shaped part. These diverters 14*a* to 14*c* are respectively controlled by the control unit 50.

As shown in FIG. 2, an inner guide member 12*a* comprising a proper fixed member is provided inside the loop-shaped part formed of the middle part 11*c*' of the transport path 11*c* and the returning transport section of the transport path 11*f*. This inner guide member 12*a* can serve to guide each paper sheet, over an outer circumferential face of the member 12*a*, along the loop-shaped part. In addition, an outer guide member 12*b* is provided outside the loop-shaped part. This outer guide member 12*b* can serve to guide each paper sheet, over an inner circumferential face of the member 12*b*, along the loop-shaped part. Further, a pair of free rollers 15*a*, 15*b* is provided in the paper sheet bunching unit 10, with transport belts 18*a*, 18*b* respectively arranged along the loop-shaped part, while being in contact with the pair of free rollers 15*a*, 15*b*. Additionally, pinch rollers 15*c*, 15*d* are provided to be respectively opposed to the free rollers 15*a*, 15*b*, in order to pinch the transport belt 18*b* between the rollers 15*a*, 15*c* as well as between the rollers 15*b*, 15*d*. These pinch rollers 15*c*, 15*d* are respectively pressed against the transport belt 18*b* by, for example, proper pressing mechanisms 15*e*, 15*f*, such as springs or the like. In this way, nip parts can be respectively provided between the free rollers 15*a*, 15*b* and the transport belt 18*b*.

With circulated operations of the respective transport belts 18*a*, 18*b* along the loop-shaped part, paper sheets can be transported along the middle part 11*c*' of the transport path 11*c* as well as along the transport path 11*f*, while being guided between the outer circumferential face of the inner guide member 12*a* and the inner circumferential face of the outer guide member 12*b*. In this case, at least one of the two rollers, around which each transport belt 18*a*, 18*b* is provided, can be rotated by a stepping motor 16. This stepping motor 16 is controlled by the control unit 50.

In this case, the number of revolutions of the stepping motor 16 can be controlled as needed. Thus, the amount of the paper sheets transported along the loop-shaped part can be determined by the factors, such as the number of revolutions of the stepping motor 16 controlled by the control unit 50, the outer diameter of each roller rotated by the motor 16, the rate of change in the rotational speed between the stepping motor 16 and each corresponding roller, and the like. In this way, the transport amount of the paper sheets along the loop-shaped part can be controlled by actuation of the stepping motor 16.

Further, a transport belt 18*c* is provided along the transport path 11*c* on the upstream side relative to the loop-shaped part. With the circulated operation of this transport belt 18*c*, the paper sheets can be transported, successively, one by one, along the transport path 11*c* on the upstream side relative to the loop-shaped part, and then fed to the loop-shaped part. This transport belt 18*c* is driven by a motor 17. The number of revolutions and/or rotational speed of the motor 17 can be controlled by the control unit 50, respectively.

Additionally, a plurality of transfer amount detection sensors (not shown) are provided for respectively detecting the transfer amount of each paper sheet transported along the transport path 11*c* located on the upstream side relative to the loop-shaped part and/or along the loop-shaped part comprising the middle part 11*c*' of the transport part 11*c* and the returning transport section of the transport path 11*f*. As the transfer amount detection sensors, rotary encoders, each adapted for detecting the number of revolutions of each roller, can be used. In addition, a time measurement means (not shown) adapted for measuring the time, at which the leading or rear end of each paper sheet is detected by the paper sheet detection sensors 13*a* to 13*d*, is provided to the control unit 50. Thus, based on the transfer amount obtained from the number of revolutions set for the motor or otherwise on the transfer amount detected by the respective transfer amount detection sensors and each time measured by the time measurement means, the transfer speed, i.e., the transfer amount per unit time, or acceleration, i.e., the rate of change in the speed per unit time, can be calculated. This calculation can also be performed by the control unit 50.

Next, the construction of the paper sheet escrow unit 20 will be discussed with reference to FIG. 1. This paper sheet escrow unit 20 is configured for winding and escrowing thereon, successively one by one, the normal paper sheets that are not ejected paper sheets, among the paper sheets fed from the feeding unit 40. Then, this paper sheet escrow unit 20 releases the paper sheets once wound thereon, by rewinding them therefrom, successively one by one. More specifically, as shown in FIG. 1, a winding roller 21 adapted for winding the paper sheets thereon is provided to the paper sheet escrow unit 20. This winding roller 21 is configured to wind thereon a pair of tapes 22*a*, 22*b*. Namely, the paper sheets can be wound around the winding roller 21, successively one by one, while being grasped or held between the pair of tapes 22*a*, 22*b*.

Figure 12:
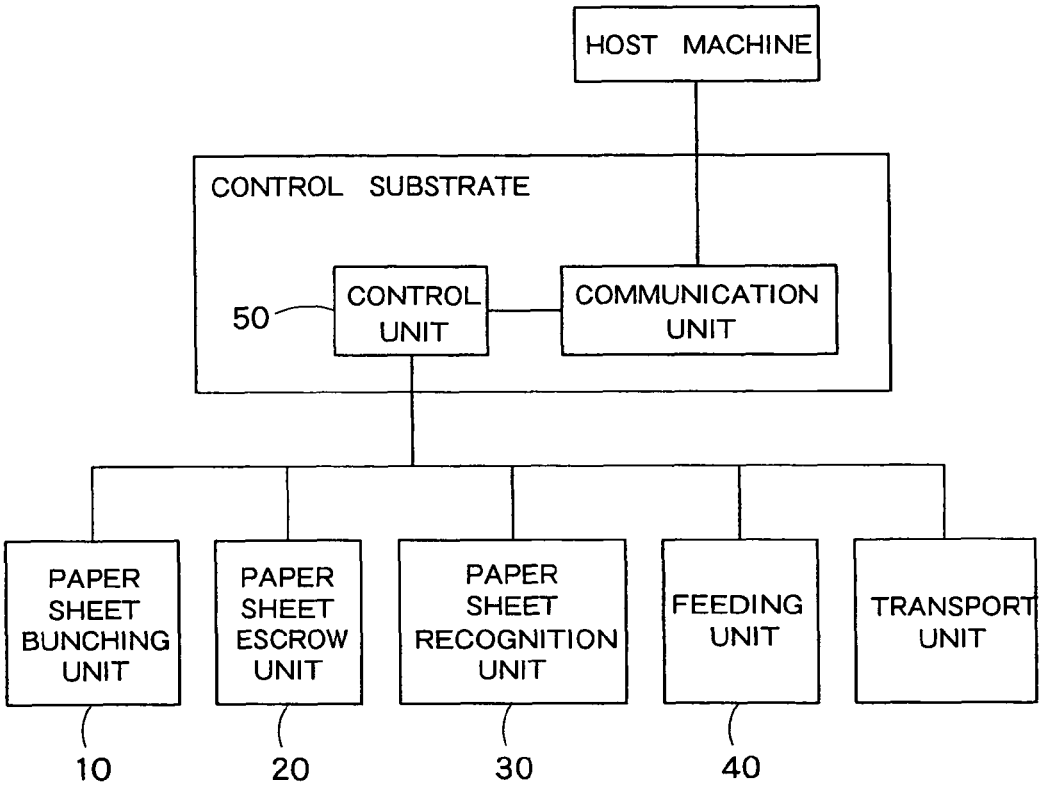
FIG. 12 is a block diagram showing construction of the control unit of the paper sheet handling machine shown in FIG. 1.

As shown in FIG. 12, the control unit 50 can control the transport unit adapted for transporting the paper sheets along the transport paths 6*a*, 6*b*, as well as control the paper sheet bunching unit 10, paper sheet escrow unit 20 and feeding unit 40. Details of the control operation performed by this control unit 50 will be described later.

It is noted that the control unit may be of a type adapted for receiving necessary commands from a host machine of the paper sheet handling machine 1, via a communication unit, as shown in FIG. 12. Alternatively, the control unit may have such a minimum construction that can control only a unit comprising the paper sheet bunching unit 10 and paper sheet escrow unit 20. Otherwise, this control unit may be designed to control a higher unit including the paper sheet recognition unit 30 and feeding unit 40, in addition to the paper sheet bunching unit 10 and paper sheet escrow unit 20, or designed to control the entire system, such as the ATM or the like.

Next, referring to FIGS. 3 to 11, the operation of the paper sheet handling machine 1 will be discussed. In general, the operation of the paper sheet handling machine 1 is performed under the control of the control unit 50, especially performed by controlling the transport unit adapted for transporting the paper sheets along the transport paths 6*a*, 6*b*, as well as by controlling each unit 10, 20, 40 and the like. In this case, a receiving slot of the paper sheet handling machine 1 is configured to receive various paper sheets, respectively placed in the slot by an operator and having different lengths.

Figure 3:
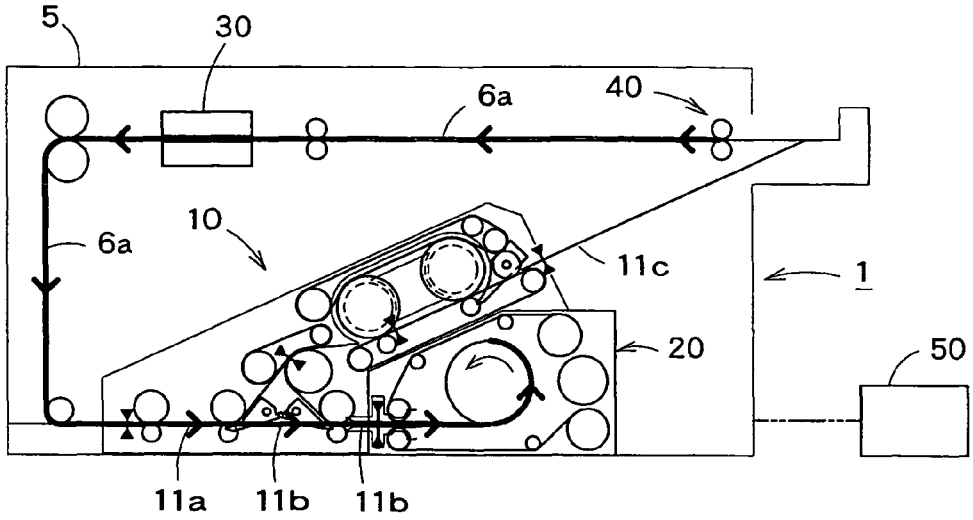
FIG. 3 is a diagram illustrating a route of the paper sheets, in the paper sheet handling machine shown in FIG. 1, when the paper sheets, which have been fed into the handling machine by a feeding unit, are transported to a paper sheet escrow unit.

First, referring to FIGS. 3 and 4, the case, in which the normal banknotes that are not ejected banknotes are fed into the casing 5 by the feeding unit 40, will be described.

The plurality of paper sheets placed in the receiving slot of the paper sheet handling machine 1 by the operator are fed, successively one by one, into the casing 5 by the feeding unit 40, and then transported along the transport path 6*a*. Thereafter, the paper sheets fed to the transport path 6*a* by the feeding unit 40 are recognized by the recognition unit 30, regarding whether or not the paper sheets are ejected ones (such as the unfit and/or counterfeit banknotes, unreadable banknotes and the like). In this case, when the paper sheets fed out by the feeding unit 40 are respectively recognized as the normal paper sheets that are not ejected paper sheets, the control unit 50 controls the diverter 14*a* to feed such paper sheets, successively one by one, into the paper sheet escrow unit 20, via the respective transport paths 6*a*, 11*a*, 11*b* (see FIG. 3).

Thereafter, the paper sheets fed into the paper sheet escrow unit 20 from the transport path 11*b* are grasped or held between the pair of tapes 22*a*, 22*b*, and then wound, one by one, around the winding roller 21, together with the pair of tapes 22*a*, 22*b*, while being grasped between the pair of tapes 22*a*, 22*b*. In this way, the plurality of paper sheets are escrowed around the winding rollers 21.

After the paper sheets are wound up and escrowed around the winding roller 21, when a command for further feeding such escrowed paper sheets to another machine located outside the paper sheet handling machine 1 is given to the control unit 50 from the host machine or the like, the paper sheets wound around the winding roller 21 will be rewound therefrom, successively one by one, and released from the grasped state between the pair of tapes 22*a*, 22*b*. Then, such released paper sheets are fed to the transport path 11*b* from the paper sheet escrow unit 20.

Figure 4:
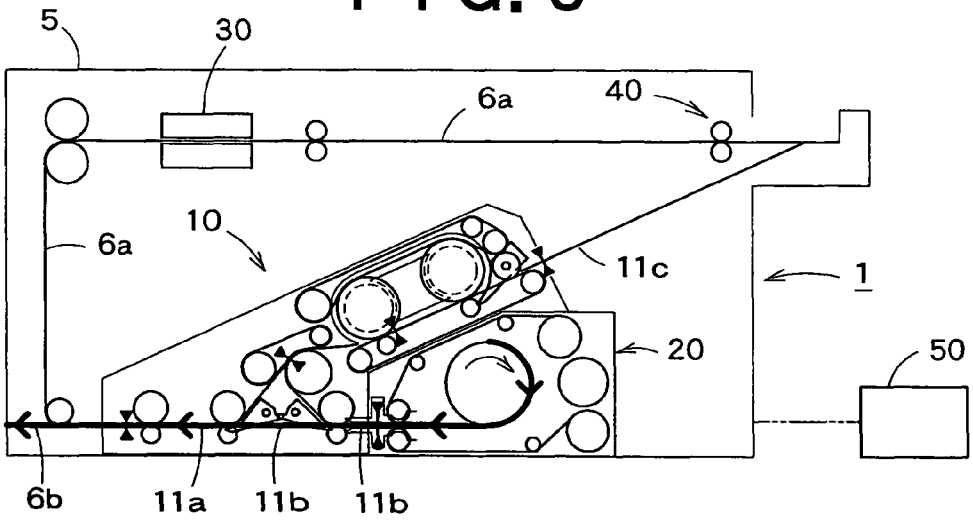
FIG. 4 is a diagram illustrating the route of the paper sheets, in the paper sheet handling machine shown in FIG. 1, when the paper sheets, which have been escrowed in the paper sheet escrow unit, are transported to another machine located outside the paper sheet handling machine.
Figure 5:
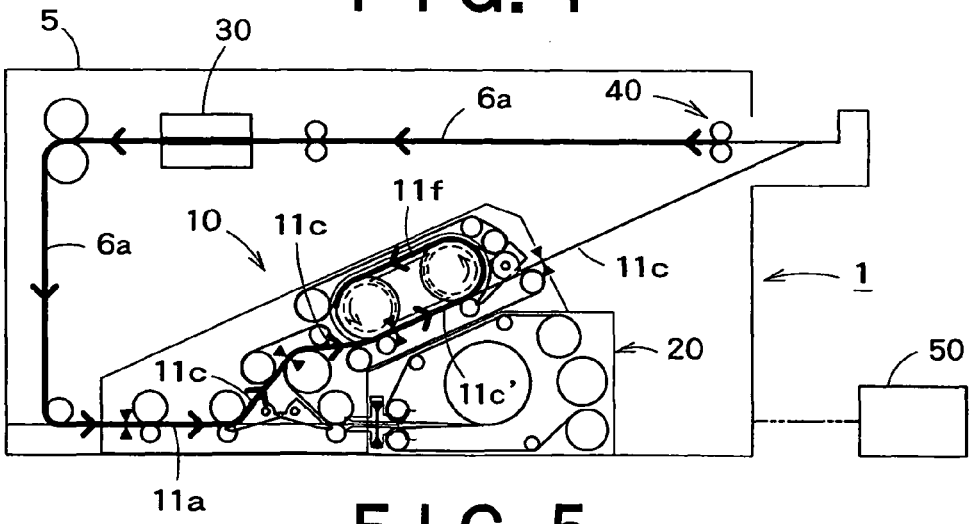
FIG. 5 is a diagram illustrating the route of the paper sheets, in the paper sheet handling machine shown in FIG. 1, when the paper sheets, which have been fed into the handling machine by the feeding unit, are transported to the paper sheet bunching unit.

Thereafter, as shown in FIG. 4, the control unit 50 controls the diverter 14*b* to feed the paper sheets released from the paper sheet escrow unit 20 to the exterior of the paper sheet handling machine 1, from the bifurcated path 6*b*, via the transport paths 11*b*, 11*a*.

Now, referring to FIGS. 5 through 10, the case, in which the ejected paper sheets (such as the unfit and/or counterfeit banknotes, unreadable banknotes and the like) are fed into the casing 5 by the feeding unit 40 in the paper sheet handling machine 1 will be discussed.

The plurality of paper sheets placed in the receiving slot of the paper sheet handling machine 1 by the operator are fed, successively one by one, into the casing 5 by the feeding unit 40, and then transported along the transport path 6*a*. Thereafter, the paper sheets fed out by the feeding unit 40 are recognized by the recognition unit 30, regarding whether or not the paper sheets are the ejected ones. In this case, if some paper sheets fed out by the feeding unit 40 are recognized as the ejected paper sheets by the paper sheet recognition unit 30, the control unit 50 controls the diverter 14*a* to feed such ejected paper sheets, successively one by one, to the transport path 11*c*, via the transport paths 6*a*, 11*a*. Further, when the motor 17 is actuated to rotate the transport belt 18*c* in a direction designated by an arrow in FIG. 2, the paper sheets fed to the transport path 11*c* are transported by the transport belt 18*c*, and then reach the loop-shaped part provided in the middle part of the transport path 11*c* (see FIG. 5).

Then, the control unit 50 controls the stepping motor 16 to rotate the transport belts 18*a*, 18*b* in directions respectively designated by arrows in FIG. 2. Thus, the paper sheets fed to the loop-shaped part can be circulated along the loop-shaped part by the transport belts 18*a*, 18*b*, respectively. During this period, the control unit 50 controls the diverter 14*c* not to eject the paper sheets circulated along the loop-shaped part to the exterior of the casing 5 form the transport path 11*c*. In this case, as will be detailed below, the control unit 50 controls the respective transport belts 18*a*, 18*b* to be intermittently rotated. With this feed operation for successively feeding the ejected paper sheets, among the paper sheets fed successively into the casing 5 by the feeding unit 40, to the loop-shaped part provided in the middle of the transport path 11*c* of the paper sheet bunching unit 10, the plurality of paper sheets can be held by the loop-shaped part.

In the loop-shaped part provided in the middle of the transport path 11*c* of the paper sheet bunching unit 10, the plurality of paper sheets can be circulated, while being in the batch form, with specified positions in the transport direction of the respective paper sheets aligned with one another. More specifically, the paper sheets can be circulated, in the batch form, with the leading ends, rear ends or central positions of the respective paper sheets aligned with one another. Alternatively, the specified position of each paper sheet may be such a position that makes a constant ratio of a distance from the leading end of the paper sheet to the specified position thereof relative to the whole length in the transport direction of the paper sheet. In this case, however, one approach for aligning the leading ends of the plurality of paper sheets with one another in the loop-shaped part will be discussed with reference to FIGS. 6A to 6*c* and FIG. 13.

Figure 6A:
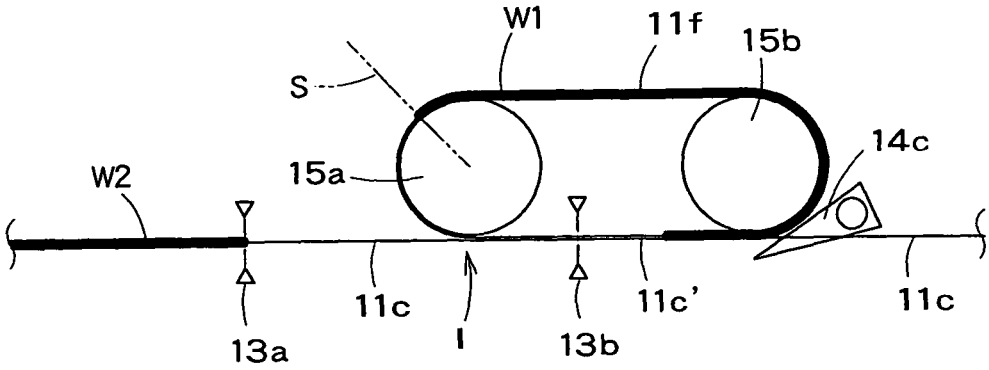
FIG. 6A is a diagram illustrating a state in the paper sheet bunching unit of the paper sheet handling machine shown in FIG. 1, when the leading end (or ends) of one paper sheet (or a batch of paper sheets) is located in a waiting position along the loop-shaped part of the transport path, while the leading end of another paper sheet reaches a paper sheet detection sensor along the transport path located on the upstream side relative to the loop-shaped part, in order to align the leading ends of these paper sheets with one another.

Usually, the transport belts 18*a*, 18*b* are stopped, respectively, such that the leading end (or ends) of one paper sheet (or the batch of paper sheets) W1 present on the loop-shaped part can be stopped in the waiting position S, as shown in FIG. 6A. In this state, a new paper sheet W2 is fed to the transport path 11*c* at a constant speed V, and then light usually transmitted to the paper sheet detection sensor 13*a* provided to the transport path 11*c* is blocked by the leading end of the new paper sheet W2. Simultaneously, the time ($T_0$ in FIG. 13), at which the light transmitted to the paper sheet detection sensor 13*a* is blocked, is measured by the time measurement means. Meanwhile, at this time $T_0$, the control unit 50 actuates each transport belt 18*a*, 18*b*, by controlling the number of revolutions and/or rotational amount of each stepping motor 16 provided for rotating the belt 18*a* or 18*b*, thereby to start accelerating the paper sheet W1, at a constant rate of acceleration, along the returning transport section of the transport path 11*f*. In this manner, once the transfer speed of the paper sheet W1 becomes substantially the same as the transfer speed of the paper sheet W2, the acceleration for the paper sheet W1 is stopped. In this case, each transfer speed of the paper sheets W1 and W2 is calculated and detected by the control unit 50, based on each transfer amount and measured time.

Figure 6B:
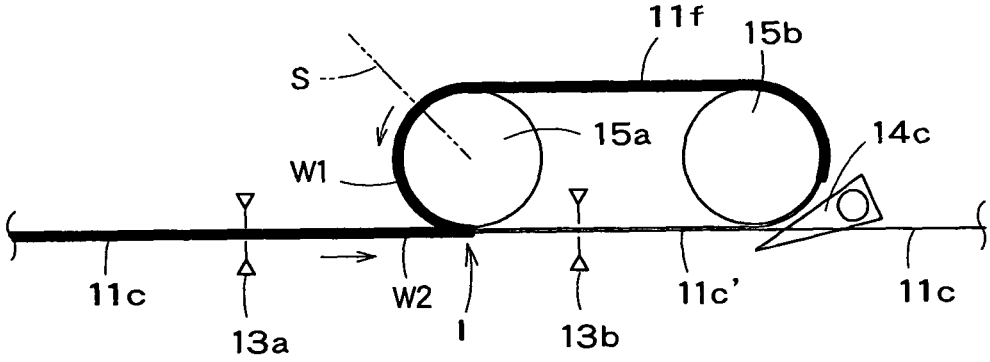
FIG. 6B is a diagram illustrating another state after the state shown in FIG. 6A, when the leading end of the paper sheet, after being detected by the paper sheet detection sensor, reaches an inlet of the loop-shaped part, while the leading end (or leading ends) of the waiting paper sheet (or paper sheets), after being moved along the loop-shaped part, also reaches the inlet of the loop-shaped part.
Figure 6C:
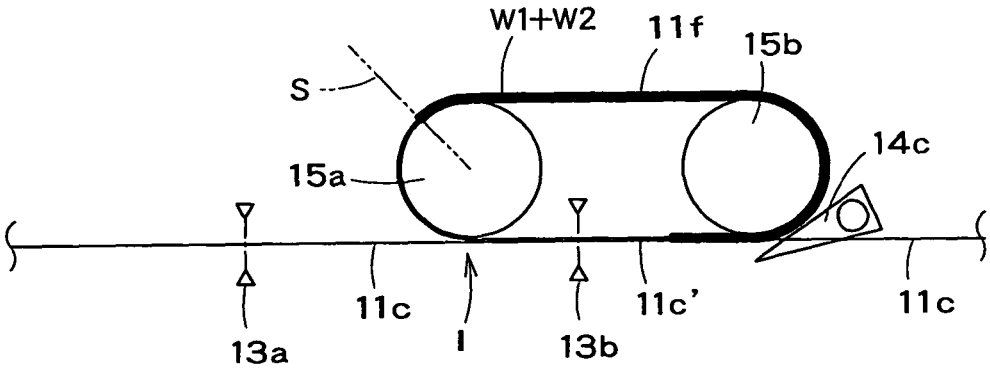
FIG. 6C is a diagram illustrating another state after the state shown in FIG. 6B, when the paper sheet detected by the paper sheet detection sensor and the paper sheet (or paper sheets) moved along the loop-shaped part are joined together at the inlet of the loop-shaped part, and then such joined paper sheets are further circulated along the loop-shaped part, and finally reach and stop in the waiting position again.
Figure 13:
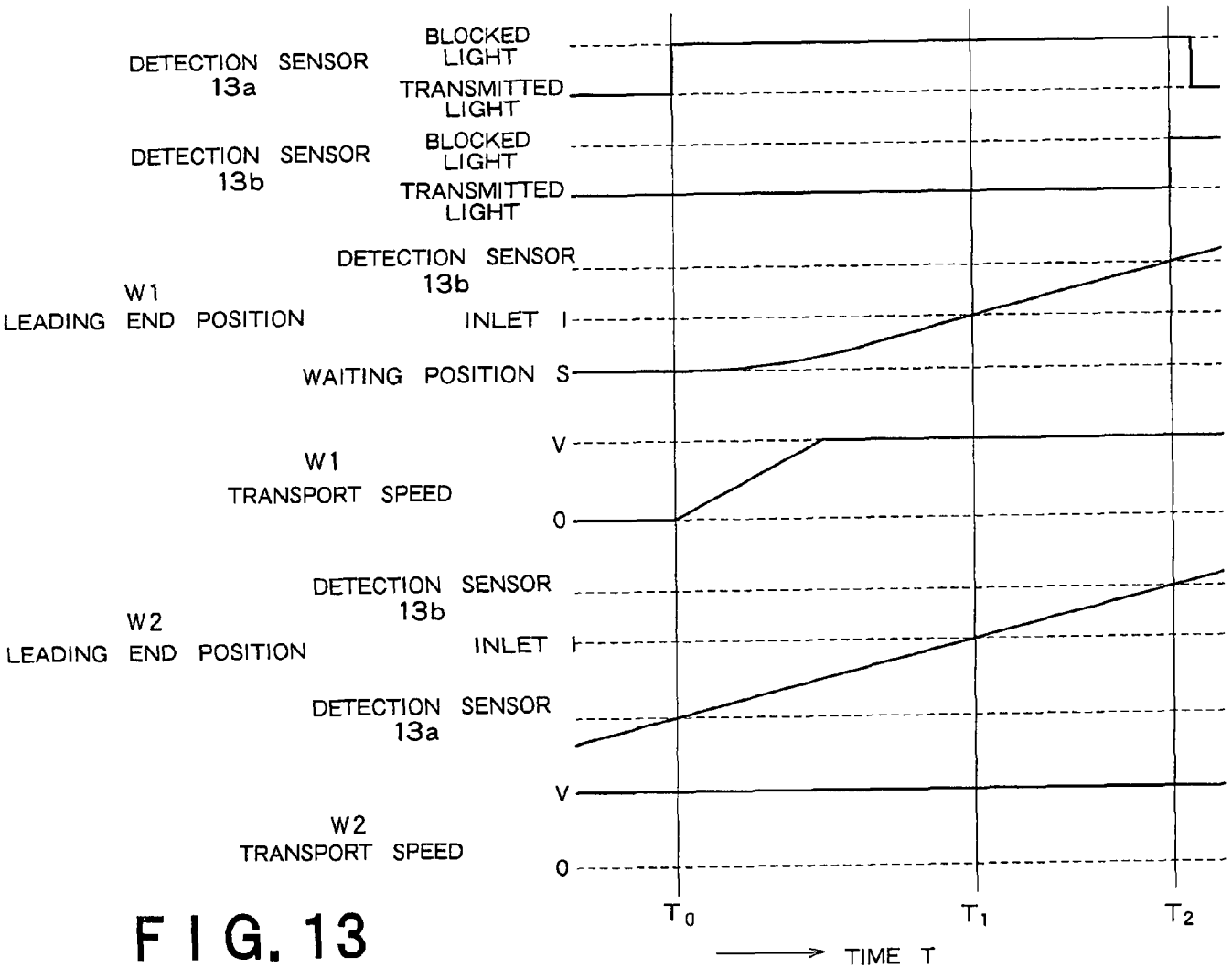
FIG. 13 is a timing chart showing one example of the operation of the paper sheet bunching unit of the paper sheet handling machine shown in FIG. 1.

In this case, the rate of acceleration and time for the acceleration for the paper sheet W1 are respectively set in advance in the control unit 50, such that the leading end of the paper sheet W1, after being moved from the waiting position S, can reach the inlet I of the loop-shaped part, at the same time that the leading end of the paper sheet W2, after being transferred from the position corresponding to the paper sheet detection sensor 13*a*, reaches the inlet I of the loop-shaped part. As used herein, the inlet I of the loop-shaped part means a connection point between the transport path 11*c* and a downstream end of the returning transport section of the transport path 11*f* (see FIGS. 6A to 6C). In this way, as shown in FIG. 6B, the control unit 50 controls the stepping motor 16, such that the leading end of the paper sheet W1 circulated from the waiting position S can be aligned with the leading end of the paper sheet W2 that has been detected by the paper sheet detection sensor 13*a*, at the inlet I of the loop-shaped part. More specifically, the control unit 50 controls the stepping motor 16, such that the time ($T_1$ in FIG. 13), at which the leading end of the paper sheet W1 circulated from the waiting position S along the loop-shaped part reaches the inlet I of the loop-shaped part, can be substantially coincident with the time at which the leading end of the paper sheet W2 that has been detected by the paper sheet detection sensor 13*a* reaches the inlet I of the loop-shaped part. It is noted that this time $T_1$ is not actually measured, but is calculated, based on the transfer speed of the paper sheet W2 and the distance between the paper sheet detection sensor 13*a* and the inlet I of the loop-shaped part. Further, for allowing the leading end of the paper sheet W1 to reach the inlet I at the time $T_i$, the transfer speed of the paper sheet W1 is controlled, based on the distance from the waiting position S to the inlet I of the loop-shaped part. In addition, as shown in FIG. 13, the transfer speed of the paper sheet W1 circulated from the waiting position S can be substantially the same as the transfer speed of the paper sheet W2 transported along the transport path 11*c*, at the inlet I of the loop-shaped part.

Then, as shown in FIG. 6B, the control unit 50 further rotates each transport belt 18*a*, 18*b* by using the stepping motor 16, while the leading end of the paper sheet W1 circulated from the waiting position S is substantially aligned with the leading end of the paper sheet W2 that has been detected by the paper sheet detection sensor 13*a*. Consequently, the paper sheets W1, W2 can be joined together, with the leading ends thereof aligned with one another. Thereafter, such paper sheets W1, W2 will be further circulated along the loop-shaped part at the constant speed V, while being joined together. Thus, the light transmitted to the paper sheet detection sensor 13*b* will be blocked by the leading end of such a combined body of the paper sheets W1, W2. Then, the time ($T_2$ in FIG. 3), at which the light transmitted to the paper sheet detection sensor 13*b* is blocked, is measured by the time measurement means. After the combined body of the paper sheets W1, W2 is moved at the speed V for predetermined time from the time $T_2$ along the loop-shaped part by the stepping motor 16, the control unit 50 decelerates the transfer speed of the combined body. Then, the control unit 50 stops the actuation of the stepping motor 16 to temporarily keep the position of the leading end of the combined body of the paper sheets W1, W2 at the waiting position S in the loop-shaped part.

In this example, the paper sheets W1, W2 are moved and joined together, based on the speed, rate of acceleration and acceleration time, respectively set in advance. However, the positional shift between the paper sheets W1 and W2, upon the joining of these paper sheets, may be first expected by obtaining the position and speed of each paper sheet W1, W2, based on each detected transfer amount thereof. Namely, with this expectation, the control unit can further reduce such a positional shift, by optionally controlling the speed, rate of acceleration and time required for the acceleration, for each paper sheet W1, W2. In addition, if the leading end of one paper sheet reaches the inlet I before the leading end of the other paper sheet, the first one may be stopped to wait for the other one. Then, once the other delayed paper sheet is decelerated or stopped at the inlet I, both of the paper sheets can be moved again, while the leading ends thereof are aligned with one another. In either case, both of the paper sheets W1, W2 can be joined together, with the transfer speed of such paper sheets being controlled to be substantially the same relative to each other.

If the light transmitted to the paper sheet detection sensor 13 is not actually blocked by the leading end of the combined body of the paper sheets W1, W2 at the time $T_2$ that the light is normally blocked, the control unit 50 will judge occurrence of some error at a point later in time, and thus stop the transportation of the paper sheets W1, W2, such as by controlling the stepping motor 16.

Namely, once the light transmitted to the paper sheet detection sensor 13 is blocked by the leading end of the paper sheet W2, and when the paper sheet W2 is fed to the loop-shaped part, the control unit 50 controls the stepping motor 16 to actuate the transport belts 18*a*, 18*b* to circulate the one paper sheet or the batch of paper sheets W1 already held on the loop-shaped part, such that the paper sheet W1, W2 can be joined together, with the leading ends of such paper sheets W1, W2 substantially aligned with one another. Therefore, this approach can stack the various paper sheets respectively having different lengths, one on another, into the batch form, with the leading ends thereof being securely aligned with one another.

Next, another approach for aligning the leading ends of the plurality of paper sheets with one another in the loop-shaped part will be discussed with reference to FIG. 7A.

Figure 7A:
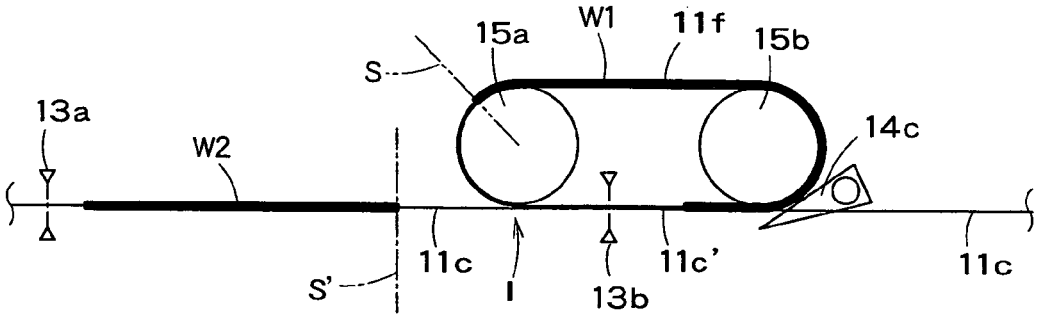
FIG. 7A is a diagram illustrating another state in the paper sheet bunching unit of the paper sheet handling machine shown in FIG. 1, when the leading end (or ends) of the one paper sheet (or the batch of paper sheets) is located in the waiting position along the loop-shaped part of the transport path, while the leading end of another paper sheet reaches a predetermined position on the downstream side relative to the paper sheet detection sensor on the transport path located on the upstream side relative to the loop-shaped part, in order to align the leading ends of the respective paper sheets with one another.

Again, the transport belts 18*a*, 18*b* are usually stopped, respectively, such that the leading end (or ends) of the one paper sheet (or the batch of paper sheets) W1 present on the loop-shaped part can be stopped in the waiting position S, as shown in FIG. 7A. In this state, the new paper sheet W2 is fed to the transport path 11*c* at the constant speed V, and thus the light usually transmitted to the paper sheet detection sensor 13*a* provided to the transport path 11*c* is blocked by the leading end of the new paper sheet W2. Further, as shown in FIG. 7A, a predetermined position S' is set in advance along the transport path 11*c* on the upstream side relative to the loop-shaped part as well as on the downstream side relative to the paper sheet detection sensor 13*a*. Namely, in this case, that the leading end of the paper sheet W2 will reach the predetermined position S', after a preset period of time later than the detection of the leading end of the paper sheet W2 by the paper sheet detection sensor 13*a*. In this manner, when the leading end of the paper sheet W2 reaches the predetermined position S' on the downstream side of the paper sheet detection sensor 13*a*, the control unit 50 controls the stepping motor 16 to start the respective transport belts 18*a*, 18*b*, thereby accelerating the paper sheet (or paper sheets) W1, with uniform acceleration, along the returning transport section of the transport path 11*f*.

In this way, once the transfer speed of the paper sheet W1 becomes substantially the same as the transfer speed of the paper sheet W2, the acceleration for the paper sheet W1 is stopped. The transfer speed of each paper sheet W1, W2 can be calculated and detected by the control unit 50, based on each transfer amount and measured time. It is noted that the aforementioned transfer amount detection sensors may be used for detecting that the leading end of the paper sheet W2 reaches the predetermined position S'.

In this case, the rate of acceleration and time for the acceleration for the paper sheet W1 are respectively set in advance in the control unit 50, such that the leading end of the paper sheet W1, after being moved from the waiting position S, can reach the inlet I of the loop-shaped part, at the same time that the leading end of the paper sheet W2, after being transferred from the predetermined position S' on the downstream side of the paper sheet sensor 13*a*, reaches the inlet I of the loop-shaped part. In this manner, the control unit 50 controls the stepping motor 16, such that the leading end of the paper sheet W1 circulated from the waiting position S can be aligned with the leading end of the paper sheet W2 moved from the predetermined position S, at the inlet I of the loop-shaped part. More specifically, the control unit 50 controls the stepping motor 16, such that the time, at which the leading end of the paper sheet W1 circulated from the waiting position S along the loop-shaped part reaches the inlet I of the loop-shaped part, can be substantially coincident with the time at which the leading end of the paper sheet W2 moved from the predetermined position S' reaches the inlet I of the loop-shaped part. Additionally, at the inlet I of the loop-shaped part, the transfer speed of the paper sheet W1 circulated from the waiting position S can be substantially the same as the transfer speed of the paper sheet W2 transported along the transport path 11*c*.

Then, the control unit 50 controls the stepping motor 16 to further rotate the respective transport belts 18*a*, 18*b*, while the leading end of the paper sheet W1 circulated from the waiting position S is substantially aligned with the leading end of the paper sheet W2 transferred from the predetermined position S'. As a result, such paper sheets W1, W2 can be joined together and then further circulated along the loop-shaped part at the constant speed V, with the leading ends thereof aligned with one another.

Next, referring to FIG. 7B, one approach for aligning the rear ends of the plurality of paper sheets with one another in the loop-shaped part will be discussed.

Figure 7B:
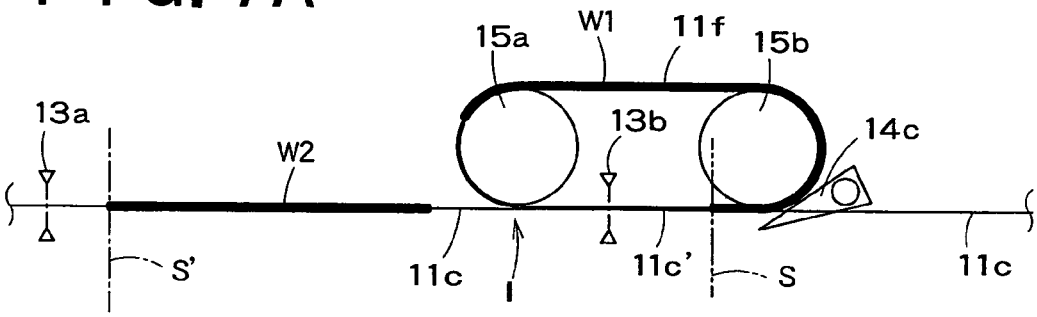
FIG. 7B is a diagram illustrating another state in the paper sheet bunching unit of the paper sheet handling machine shown in FIG. 1, when the rear end (or ends) of one paper sheet (or the batch of paper sheets) is located in the waiting position along the loop-shaped part of the transport path, while the rear end of another paper sheet reaches the predetermined position on the downstream side relative to the paper sheet detection sensor on the transport path located on the upstream side relative to the loop-shaped part, in order to align the rear ends of the respective paper sheets with one another.

Again, the transport belts 18*a*, 18*b* are usually stopped, respectively, such that the rear end (or ends) of one paper sheet (or the batch of paper sheets) W1 present on the loop-shaped part can be stopped in the waiting position S, as shown in FIG. 7B. Meanwhile, the new paper sheet W2 is fed to the transport path 11*c* at the constant speed V. In this state, the light usually transmitted to the paper sheet detection sensor 13*a* is blocked, when the leading end of the paper sheet W2 reaches the paper sheet detection sensor 13*a*, while the light can be transmitted again to the paper sheet detection sensor 13*a*, when the rear end of the paper sheet W2 reaches the paper sheet detection sensor 13*a*. As a result, the whole length in the transport direction (i.e., the distance from the leading end to the rear end) of the paper sheet W2 can be calculated based on the detection result of the paper sheet detection sensor 13*a*. Meanwhile, as shown in FIG. 7B, the predetermined position S' is set along the transport path 11*c* on the upstream side relative to the loop-shaped part as well as on the downstream side relative to the paper sheet detection sensor 13*a*, such that the rear end of the paper sheet W2 can reach this position S' after a preset period of time later than the detection of the rear end of the paper sheet W2 by the paper sheet detection sensor 13*a*. In this manner, when the rear end of the paper sheet W2 reaches the predetermined position S' on the downstream side of the paper sheet detection sensor 13*a*, the control unit 50 controls the stepping motor 16 to start the respective transport belts 18*a*, 18*b*, thereby accelerating the paper sheet (or paper sheets) W1, with uniform acceleration, along the returning transport section of the transport path 11*f*. In this way, once the transfer speed of the paper sheet W1 is substantially the same as the transfer speed of the paper sheet W2, the acceleration for the paper sheet W1 is stopped. It is noted that the transfer speed of each paper sheet W1, W2 can be calculated and detected by the control unit 50, based on each transfer amount and measured time.

In this case, the rate of acceleration and time for the acceleration for the paper sheet W1 are respectively set in advance in the control unit 50, such that the rear end of the paper sheet W1, after being moved from the waiting position S, can reach the inlet I of the loop-shaped part, at the same time that the rear end of the paper sheet W2, after being transferred from the predetermined position S' on the downstream side of the paper sheet detection sensor 13*a*, reaches the inlet I of the loop-shaped part. In this manner, the control unit 50 controls the stepping motor 16, such that the rear end of the paper sheet W1 circulated from the waiting position S can be aligned with the rear end of the paper sheet W2 transferred from the predetermined position S', at the inlet I of the loop-shaped part. More specifically, the control unit 50 controls the stepping motor 16, such that the time, at which the rear end of the paper sheet W1 circulated from the waiting position S along the loop-shaped part reaches the inlet I of the loop-shaped part, can be substantially coincident with the time at which the rear end of the paper sheet W2 transferred from the predetermined position S' reaches the inlet I of the loop-shaped part. Additionally, at the inlet I of the loop-shaped part, the transfer speed of the paper sheet W1 circulated from the waiting position S can be substantially the same as the transfer speed of the paper sheet W2 transported along the transport path 11*c*.

Then, the control unit 50 controls the stepping motor 16 to further rotate the respective transport belts 18*a*, 18*b*, while the rear end of the paper sheet W1 circulated from the waiting position S is substantially aligned with the rear end of the paper sheet W2 transferred from the predetermined position S'. As a result, such paper sheets W1, W2 can be joined together and further circulated along the loop-shaped part at the constant speed V, with the rear ends thereof aligned with one another. During this circulation, the leading end and rear end of the combined body of the paper sheets W1, W2 are respectively detected by the paper sheet detection sensor 13*b*. Additionally, the points of time, at which the leading end and rear end of the combined body of the paper sheets W1, W2 are respectively detected, are respectively measured by the time measurement means. Thereafter, the control unit 50 controls the stepping motor 16 to move the combined body of the paper sheets W1, W2 for a predetermined period of time along the loop-shaped part, and then stops the actuation of the stepping motor 16 to temporarily keep the position of the rear end of the combined body of W1, W2 at the waiting position S along the loop-shaped part.

In this manner, once the rear end of the paper sheet W2 reaches the predetermined position S', and when the paper sheet W2 is fed to the loop-shaped part, the control unit 50 controls the stepping motor 16 to drive the transport belts 18*a*, 18*b* to circulate the one paper sheet (or the batch of paper sheets) W1 already held on the loop-shaped part, such that the paper sheets W1, W2 can be joined together, with the rear ends of such paper sheets W1, W2 substantially aligned with one another. Therefore, this approach can also stack the various paper sheets respectively having different lengths, one on another, into the batch form, with the rear ends thereof aligned with one another.

Alternatively, the plurality of paper sheets may be circulated along the loop-shaped part, in the middle part of the transport path 11*c* of the paper sheet bunching unit 10, with the central positions in the transport direction of the respective paper sheets aligned with one another. More specifically, the leading ends and rear ends of the batch of paper sheets W1 are respectively detected by the paper sheet detection sensor 13*b*, so that the whole length of such paper sheets W1 in the transport direction can be detected. Thus, the central position of the paper sheets W1 can also be detected by the paper sheet detection sensor 13*b*. Meanwhile, the leading end and rear end of the paper sheet W2 are respectively detected by the paper sheet detection sensor 13*a*, so that the whole length of the paper sheet W2 in the transport direction can also be detected. As such, similarly, the central position of the paper sheet W2 can be detected by the paper sheet detection sensor 13*a*.

In this case, for example, the leading end (or ends) of the one paper sheet (or the batch of paper sheets) W1 is stopped at the predetermined waiting position in the loop-shaped part. However, once the paper sheet W2 is transported at the constant speed along the transport path 11*c* on the upstream side of the loop-shaped part, and when the leading end of this paper sheet W2 reaches the predetermined position, the control unit 50 controls the stepping motor 16 to start the actuation of the respective transport belts 18*a*, 18*b* and thus circulate the paper sheet W1 along the loop-shaped part, such that the central position of the paper sheet W1 can be substantially aligned with the central position of the paper sheet W2, at the inlet I of the loop-shaped part, or such that the time, at which the central position of the paper sheet W1 reaches the inlet I of the loop-shaped part, can be substantially coincident with the time at which the central position of the paper sheet W2 reaches the inlet I of the loop-shaped part. In this way, the various paper sheets, respectively having different lengths, can be stacked into the batch form on the loop-shaped part, with the respective central positions in the transport direction thereof aligned with one another.

It is noted that this approach is not limited to the case in which the paper sheets are circulated, in the batch form, along the loop-shaped part, with the central positions of the respective paper sheets aligned with one another. For instance, the paper sheets may be circulated, in the batch form, with some specified positions in the transport direction of the respective paper sheets aligned with one another. Namely, the whole length of the one paper sheet or the batch of paper sheets W1 can be obtained by the detection by the paper sheet detection sensor 13*b*, while the whole length of the paper sheet W2 can be detected by the paper sheet detection sensor 13*a*. Thus, the specified position in the transport direction of each paper sheet W1, W2 can be calculated, upon each detection performed by the respective paper sheet detection sensors 13*a*, 13*b*, by setting, in advance, the ratio of the distance between the leading end of the paper sheet and the specified position, relative to the whole length in the transport direction of the paper sheet, within a range of from 0 to 1.

As such, in substantially the same manner as in the aforementioned approach for circulating the paper sheets in the batch form along the loop-shaped part, with the central positions of the respective paper sheets aligned with one another, the paper sheets can also be circulated, in the batch form, with the specified positions in the transport direction of the respective paper sheets aligned with one another.

Figure 10:
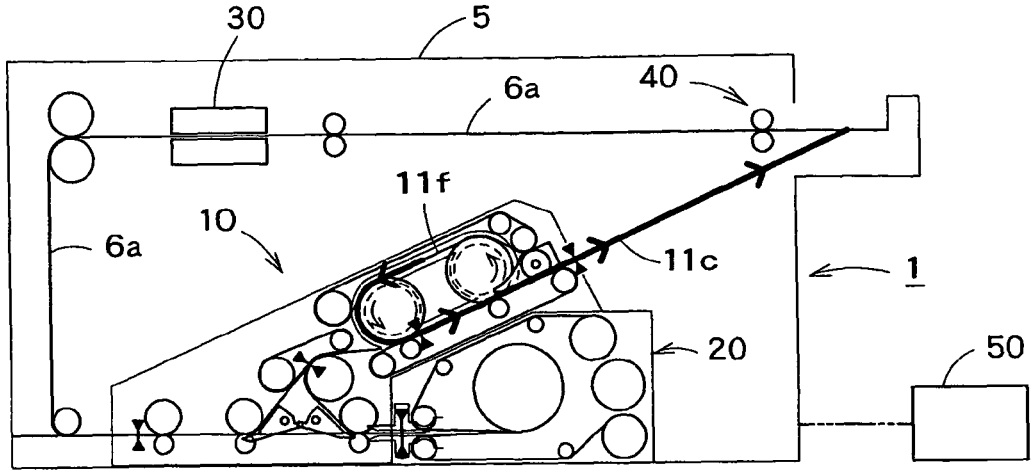
FIG. 10 is a diagram illustrating the route of the paper sheets in the paper sheet handling machine shown in FIG. 1, when the paper sheets, which have been temporarily held in the paper sheet bunching unit, are ejected to the exterior of the machine.

After the plurality of paper sheets are circulated in the batch form along the loop-shaped part provided in the middle of the transport path 11*c* of the paper sheet bunching unit 10, with the specified positions (e.g., the leading ends, rear ends, central positions or the like) in the transport direction of the respective paper sheets aligned with one another, such circulated paper sheets are finally fed out to the transport path 11*c* located on the downstream side relative to the loop-shaped part. More specifically, when a command for ejecting the paper sheets from the loop-shaped part is given to the control unit 50 from the host machine or the like, or otherwise when a predetermined number of the paper sheets are held on the loop-shaped part, the control unit 50 controls the diverter 14*c* to divert the paper sheets circulated along the loop-shaped part into the transport path 11*c* located on the downstream side of the loop-shaped part. Then, as shown in FIG. 10, the paper sheets fed to the downstream-side transport path 11*c* will be ejected to the exterior of the casing 5. In this case, the paper sheets can be ejected, in the batch form, with the specified positions in the transport direction of the paper sheets being respectively aligned with one another.

If the length in the transport direction of the paper sheet fed to the loop-shaped part along the transport path 11*c* on the upstream side relative to the loop-shaped part is longer than the predetermined length, e.g., the length that can be held on the loop-shaped part, such paper sheet is directly ejected from the loop-shaped part by the diverter 14*c*, without being held on the loop-shaped part. At this time, the one paper sheet or the batch of paper sheets already held on the loop-shaped part will also be ejected from the loop-shaped part by the actuation of the diverter 14*c*. Now, referring to FIGS. 8 and 9, such a case will be described. As used herein, the "length that can be held on the loop-shaped part" means the length (of the paper sheet) that can retain such an adequate gap in the loop-shaped part that is not occupied by the paper sheets held on the loop-shaped part and thus allows the diverter 14*c* to be advanced into the gap during the circulation of the paper sheets along the loop-shaped part. Namely, this length is slightly shorter than the whole circumferential length of the loop-shaped part.

Figure 8:
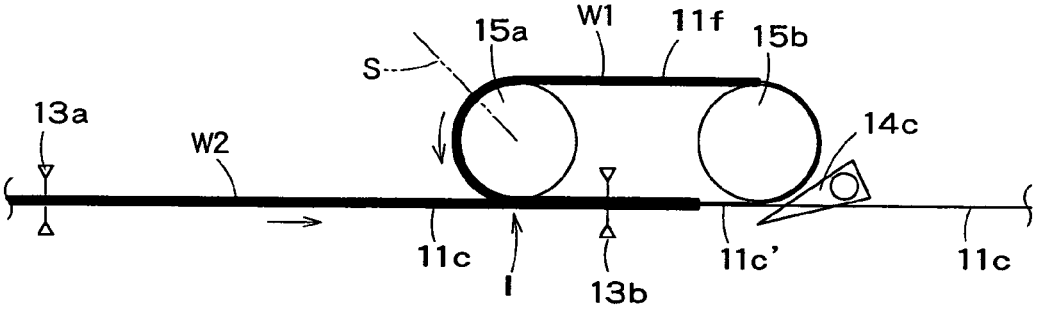
FIG. 8 is a diagram illustrating another state in the paper sheet bunching unit of the paper sheet handling machine shown in FIG. 1, wherein one paper sheet, having length longer than the length that can be held by the loop-shaped part, is fed to the loop-shaped part from the upstream side relative to the loop-shaped part, and wherein the leading end of this paper sheet is detected by one paper sheet detection sensor provided at the loop-shaped part, while this paper sheet is detected by another paper sheet detection sensor provided on the upstream side relative to the loop-shaped part along the transport path.

Specifically, as shown in FIG. 8, the length in the transport direction of the paper sheet is judged to be longer than the predetermined length (e.g., the length that can be held on the loop-shaped part), in the case the paper sheet fed from the upstream side of the loop-shaped part to the loop-shaped part is once detected by both the paper sheet detection sensor 13*a* provided in the upstream position relative to the loop-shaped part along the transport path 11*c* and the paper sheet detection sensor 13*b* provided in the middle part 11*c*' of the transport path 11*c*, and then this paper sheet is continuously detected by the paper sheet detection sensor 13*a*, even after the paper sheet is transported by a predetermined distance. More specifically, the transport distance of the paper sheet can be detected by the stepping motor 16 and/or by the transfer amount detection sensors as described above. Thus, the length in the transport direction of the paper sheet is judged to be longer than the predetermined length (e.g., the length that can be held on the loop-shaped part), in the case the leading end of the paper sheet is once detected by the paper sheet detection sensor 13*b*, and then this paper sheet is continuously detected by the paper sheet detection sensor 13*a*, even after the transport distance of the paper sheet reaches the predetermined distance. In this case, the distance between the paper sheet detection sensor 13*a* provided in the upstream position relative to the loop-shaped part along the transport path 11*c* and the paper sheet detection sensor 13*b* provided in the middle part 11*c*' of the transport path 11*c* corresponds to a value obtained by subtracting the aforementioned predetermined distance from the length of the paper sheet that can be held on the loop-shaped part.

Figure 9:
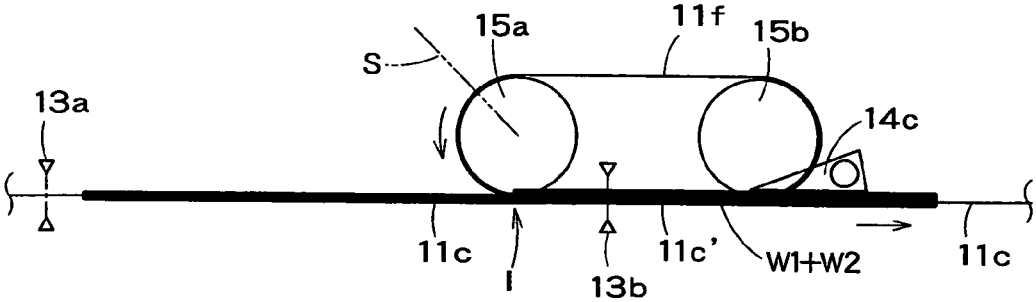
FIG. 9 is a diagram illustrating another state after the state shown in FIG. 8, when the paper sheet, having the length longer than the length that can be held by the loop-shaped part, and one paper sheet (or the batch of paper sheets) held by the loop-shaped part are ejected together from the loop-shaped part.

Meanwhile, as shown in FIG. 9, the control unit 50 controls the diverter 14*c* to be advanced into the loop-shaped part, in order to feed the paper sheet fed from the upstream side relative to the loop shaped part to the loop shaped part, together with the paper sheet (or paper sheets) circulated along the loop-shaped part, to the transport path 11*c* located on the downstream side relative to the loop-shaped part. Thereafter, as shown in FIG. 10, the paper sheets fed to the transport path 11*c* located on the downstream side of the loop-shaped part will be finally ejected to the exterior of the casing 5. During this ejection, the paper sheet fed from the upstream side relative to the loop shaped part to the loop shaped part and the one paper sheet or the batch of paper sheets circulated along the loop-shaped part may be ejected, with the specified positions thereof (e.g., the leading ends) in the transport direction aligned with one another. On the other hand, if there is no paper sheet held on the loop-shaped part, when the paper sheet having the length in the transport direction longer than the predetermined length is fed to the loop-shaped part, this paper sheet is directly fed to the transport path 11*c* located on the downstream side relative to the loop-shaped part, without being circulated around the loop-shaped part.

In another aspect, the distance between the paper sheet detection sensor 13*a* and the paper sheet detection sensor 13*b* may be the length of the paper sheet that can be held on the loop-shaped part. In this case, if some paper sheet is detected by both of the paper sheet detection sensors 13*a*, 13*b*, the length in the transport direction of this paper sheet can also be judged to be longer than the predetermined length, (e.g., the length that can be held on the loop-shaped part).

In still another aspect, in addition to the paper sheet detections sensors 13*a*, 13*b*, an additional paper sheet detection sensor (not shown) adapted for detecting the length in the transport direction of each paper sheet to be fed to the loop-shaped part from the upstream side relative to the loop-shaped part along the transport path 11*c* may be provided, in a position on the upstream side of the loop-shaped part as well as on the downstream side of the paper sheet detection sensor 13*a*, along the transport path 11*c*. In this case, whether or not the length in the transport direction of each paper sheet fed to the loop-shaped part is longer than the predetermined length is detected by using such an additional paper sheet detection sensor and the paper sheet detection sensor 13*a*, rather than being detected by using the paper sheet detection sensors 13*a*, 13*b*.

Figure 11:
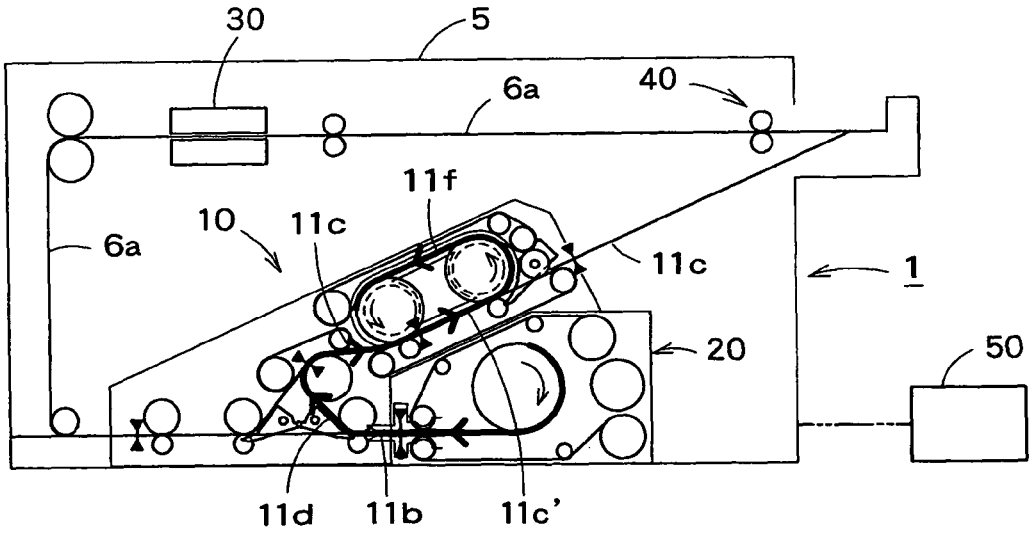
FIG. 11 is a diagram illustrating the route of the paper sheets in the paper sheet handling machine shown in FIG. 1, when the paper sheets, which have been escrowed in the paper sheet escrow unit, are transported to the paper sheet bunching unit.

Now, referring to FIG. 11, the paper sheet handling machine 1 will be further discussed, in regard to the case in which the command for ejecting the paper sheets is given to the control unit 50 from the host machine, when the paper sheet are escrowed in the paper sheet escrow unit 20.

Namely, in some cases, the command for ejecting the paper sheets escrowed in the paper sheet escrow unit 20 is given to the control unit 50 from the host machine, when the paper sheets are successively fed into the casing 5 by the feeding unit 40, while one or more of the paper sheets are wound around the winding roller 21 of the paper sheet escrow unit 20. In this case, the paper sheets escrowed in the paper sheet escrow unit 20 are ejected from the casing 5 through the paper sheet bunching unit 10. More specifically, the control unit 50 controls the diverter 14*b*, such that the paper sheets can be fed to the loop-shaped part, successively one by one, from the paper sheet escrow unit 20, via the transport paths 11*b*, 11*d*, 11*c*, in this order (see FIG. 11).

Then, the paper sheets fed to the loop-shaped part are circulated along the loop-shaped part by the actuation of the respective transport belts 18*a*, 18*b*. During this operation, the control unit 50 controls the diverter 14*c*, such that the paper sheets circulated along the loop-shaped part cannot be ejected to the exterior of the casing 5 from the transport path 11*c*. In this manner, with such successive transportation of the paper sheets escrowed in the paper sheet escrow unit 20 toward the loop-shaped part of the paper sheet bunching unit 10, the plurality of paper sheets will be held on the loop-shaped part. Thereafter, as described with reference to FIG. 10, the control unit 50 controls the diverter 14*c*, such that the paper sheets circulated around the loop-shaped part can be fed to the transport path 11*c* located on the downstream side relative to the loop-shaped part. Eventually, such paper sheets fed to the downstream side transport path 14*c* will be ejected to the exterior of the casing 5. During this operation, the paper sheets can be ejected, in the batch form, with the specified positions in the transport direction of the respective paper sheets aligned with one another.

As described above, according to the paper sheet bunching unit (or paper sheet handling mechanism) 10 related to the above embodiment and the paper sheet handling machine 1 including the paper sheet bunching unit 10, the loop-shaped part is provided in the middle part of the transport path 11*c* provided in the paper sheet bunching unit 10, such that the paper sheet (or paper sheets) W1 can be circulated around and held on the loop-shaped part. In addition, the paper sheet detection sensor 13*a* adapted for detecting the paper sheet W2 fed along the transport path 11*c* is provided to the transport path 11*c* located in the upstream side position relative to the loop-shaped part. With this configuration, once the paper sheet W2 is detected by the paper sheet detection sensor 13*a*, and when the detected paper sheet W2 is fed to the loop-shaped part, the paper sheets W1, W2 can be joined together, with the specified position in the transport direction of the paper sheet W2 substantially aligned with the specified position in the transport direction of the one paper sheet or the batch of paper sheets W1 already held on the loop-shaped part.

In this way, the newly transported paper sheet W2 can be stacked on the one paper sheet or the batch of paper sheets W1 held on the loop-shaped part comprising the middle part 11*c*' of the transport path 11*c* and the returning transport section of the transport path 11*f*, during one circulation of the paper sheet (or paper sheets) W1 around the loop-shaped part. Besides, during this stacking operation, the specified positions in the transport direction of the respective paper sheets W1, W2 can be aligned with one another. As a result, the plurality of paper sheets, respectively having different lengths, can be temporarily held, in the batch form, on the loop-shaped part, with the specified positions of such paper sheets, respectively having different lengths, being rapidly aligned with one another. As such, the paper sheet bunching unit 10 according to the present invention can rapidly stack the paper sheets fed therein, thus providing a significantly high-speed operation.

Additionally, since the paper sheets can be held on the loop-shaped part with the circulation of the respective paper sheets around the loop-shaped part, the space required for holding the paper sheets can be substantially reduced, as compared with, for example, such a machine that requires the reciprocating operation for the paper sheets already stacked in the batch form, every time the new paper sheet is stacked with the batch of paper sheets. Therefore, the paper sheet bunching unit 10 of this invention can be provided in a significantly downsized form.

Further, in the paper sheet bunching unit 10 of this embodiment, once the transport belts 18*a*, 18*b* are usually controlled to keep the leading end (or leading ends) or rear end (or rear ends) of the paper sheet (or paper sheets) W1 present on the loop-shaped part in the predetermined waiting position S, and when the leading end of the paper sheet W2 is detected by the paper sheet detection sensor 13*a*, or when the leading end or rear end of the paper sheet W2 reaches the predetermined position S' located on the downstream side relative to the paper sheet detection sensor 13*a*, the control unit 50 controls the stepping motor 16, such that the waiting paper sheet W1 can be circulated again around the loop-shaped part and returned to the waiting position S. Additionally, the control unit 50 controls the related units, such that the time, at which the specified position in the transport direction of the paper sheet W2 detected by the paper sheet detection sensor 13*a* reaches the inlet I of the loop-shaped part, can be substantially coincident with the time at which the specified position in the transport direction of the paper sheet (or paper sheets) W1 circulated from the waiting position S along the loop-shaped part reaches the inlet I of the loop-shaped part. With this configuration, once the paper sheet W2 is detected by the paper sheet detection sensor 13*a*, and when the detected paper sheet W2 is fed to the loop-shaped part, the paper sheets W1, W2 can be joined together, with the specified position in the transport direction of the paper sheet W2 aligned, more securely, with the specified position in the transport direction of the one paper sheet or the batch of paper sheets W1 already held on the loop-shaped part in the batch form.

In addition, with the provision of the aforementioned paper sheet detection sensors 13*a*, 13*b*, stepping motor 16 and transfer amount detection sensors (hereinafter, if required, such paper sheet detection sensors 13*a*, 13*b*, stepping motor 16 and transfer amount detection sensors will be collectively referred to as "paper sheet length detector"), the length in the transport direction of the paper sheet W2 fed to the loop-shaped part from the upstream side relative to the loop-shaped part along the transport path 11*c* can be detected. If this length in the transport direction of the paper sheet W2 is longer than the predetermined length, e.g., the length that can be held on the loop-shaped part, such a paper sheet W2 will be ejected from the loop-shaped part. Therefore, even if the paper sheet W2, having the length longer than the length that can be held on the loop-shaped part, is fed to the loop-shaped part, such a paper sheet W2 can be directly ejected, without being held by the loop-shaped part.

If the paper sheet having the length longer than the length that can be held on the loop-shaped part is held, inadvertently or accidentally, by the loop-shaped part, such a longer paper sheet would be circulated along the loop-shaped part over substantially the whole circumferential face of the loop-shaped part, thus blocking the advancement of the diverter 14*c*, for ejecting the paper sheets from the loop-shaped part, into the loop-shaped part. As a result, the plurality of paper sheets held on the loop-shaped part cannot be ejected to the downstream side from the loop-shaped part. However, this problem can be securely solved by the paper sheet bunching unit 10 of the present embodiment, because the paper sheet having the length longer than the length that can be held on the loop-shaped part can be directly ejected, without being held by the loop-shaped part.

It is noted that the paper sheet bunching unit (or paper sheet handling mechanism) 10 of the present invention is not limited to the aspects as described above, but various modifications can be made thereto without departing from the scope of this invention.

Now, one variation of the paper sheet bunching unit 10 according to the present invention will be described with reference to FIG. 14. The paper sheet bunching unit 10 shown in FIG. 14 has substantially the same construction as that of the paper sheet bunching unit 10 shown in FIG. 2, except that the paper sheet detection sensor 13*b* provided to the loop-shaped part is eliminated from the paper sheet bunching machine 10.

In the paper sheet bunching unit 10 related to this variation, once the leading end of the paper sheet W2 is detected by the paper sheet detection sensor 13*a*, or once the leading end or rear end of the paper sheet W2 reaches the predetermined position S' located on the downstream side relative to the paper sheet detection sensor 13*a*, and when the one paper sheet or the batch of paper sheets W1 is moved by a preset distance (e.g., by one round of the loop-shaped part) along the loop-shaped part by the stepping motor 16, the stepping motor 16 is controlled to stop the transportation of the combined body of the paper sheets W1, W2 along the loop-shaped part. In this way, the transport operation for the respective paper sheets can be controlled, such that once the leading end or rear end of the paper sheet (or paper sheets) W1 present on the loop-shaped part is usually kept in the predetermined waiting position S, and when, for example, the leading end of the paper sheet W2 is detected by the paper sheet detection sensor 13*a*, the waiting paper sheet (or paper sheets) W1 can be circulated around the loop-shaped part and moved again up to the predetermined waiting position S. Also in this case, the control unit 50 controls the respective transport belts 18*a*, 18*b*, such that the time, at which, for example, the specified position in the transport direction of the paper sheet W2 detected by the paper sheet detection sensor 13*a* reaches the inlet I of the loop-shaped part, can be substantially coincident with the time at which the specified position in the transport direction of the paper sheet (or paper sheets) W1 circulated from the predetermined waiting position S along the loop-shaped part reaches the inlet I of the loop-shaped part.

In this case, the paper sheet detection sensor 13*a* can also serve to detect whether or not the length in the transport direction of the paper sheet W2 fed to the loop-shaped part from the upstream side relative to the loop-shaped part along the transport path 11*c* is longer than the predetermined length. More specifically, the paper sheet W2 is transported at the constant speed by the transfer belt 18*c* along the transport path 11*c* located on the upstream side relative to the loop-shaped part, and the light usually transmitted to the paper sheet detection sensor 13*a* is blocked, when the leading end of the paper sheet W2 reaches this sensor 13*a*. Thereafter, if the paper sheet W2 is continuously detected by the paper sheet detection sensor 13*a* (i.e., the light usually transmitted to the paper sheet detection sensor 13*a* is continuously blocked by the paper sheet W2) even after the paper sheet W2 is transported by the predetermined length, this paper sheet W2 will be judged to have the length in the transport direction longer than the predetermined length.

Once the control unit 50 judges that the whole length in the transport direction of the paper sheet W2 detected by the paper sheet detection sensor 13*a* is longer than the predetermined length, e.g., the length that can be held on the loop-shaped part, the control unit 50 will control the diverter 14*c* to be advanced in the loop-shaped part, similarly to the case shown in FIG. 9, thereby to feed such a paper sheet W2 fed from the upstream side relative to the loop shaped part to the loop shaped part, together with the paper sheet (or paper sheets) W1 circulated along the loop-shaped part, to the transport path 11*c* located on the downstream side relative to the loop-shaped part. During this operation, the paper sheet W2 fed to the loop-shaped part from the upstream side relative to the loop-shaped part as well as the one paper sheet or the batch of paper sheets W1 circulated along the loop-shaped part may be ejected together, in the batch form, from the loop-shaped part, with the specified positions in the transport direction of such paper sheets W1, W2 aligned with one another.

Figure 14:
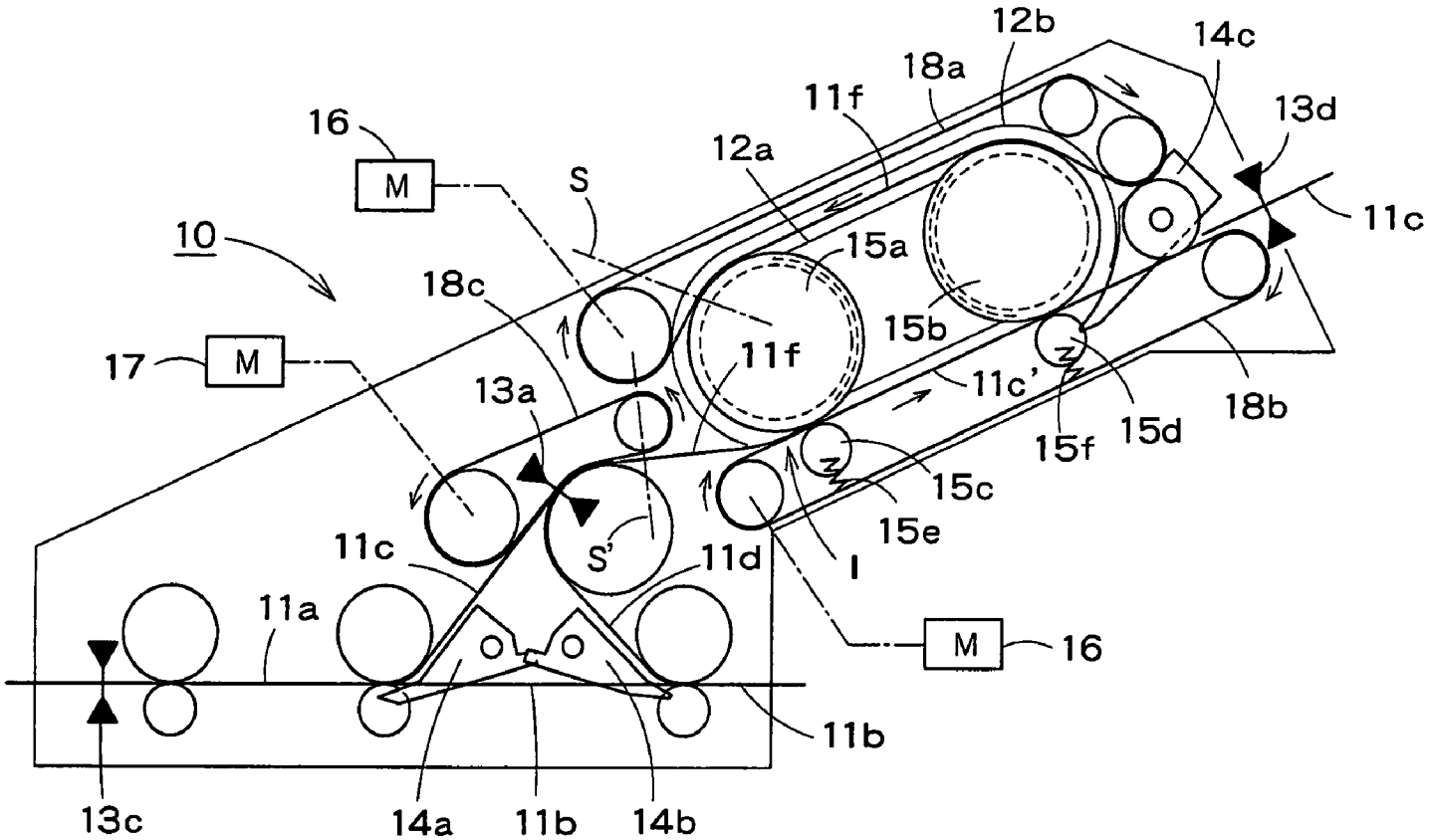
FIG. 14 is a schematic view illustrating another construction of the paper sheet bunching unit of the paper sheet handling machine.

One variation of the paper sheet bunching unit 10 shown in FIG. 14 may be configured, such that the leading end and rear end of the paper sheet W2 to be fed to the loop-shaped part from the upstream side relative to the loop-shaped part along the transport path 11*c* can be respectively detected by the paper sheet detection sensor 13*a*, and then the length in the transport direction of the paper sheet W2 can be detected, based on the transport speed of the paper sheet W2 and each detection time of the leading end and rear end of the paper sheet W2, whereby the detected length in the transport direction of the paper sheet W2 can be compared with the predetermined length, e.g., the length of the paper sheet that can be held on the loop-shaped part. After this comparison, if the detected length in the transport direction of the paper sheet W2 is longer than the predetermined length, this paper sheet W2 and the paper sheet (or paper sheets) W1 will be stacked one on another and then ejected, in the batch form, from the loop-shaped part. In this case, however, the paper sheet detection sensor 13*a* should be located sufficiently far away from the loop shaped part. It is noted that there is no need to always detect the leading end and rear end of the paper sheet W2 by using only one sensor. Namely, a plurality of sensors may be used for such detection.

Further, this invention is not limited to the case, in which both of the paper sheets W1, W2 are joined together, with the specified positions (e.g., the leading ends, rear ends, central positions or the like) of the respective paper sheets substantially aligned with one another. For instance, another variation of the above embodiments may be configured, such that the paper sheet W2 fed to the loop-shaped part from the transport path 11*c* located on the upstream side relative to the loop-shaped part and the batch of paper sheets W1 held on the loop-shaped part can be joined together, with the specified position in the transport direction of the paper sheet W2 fed from the upstream side relative to the loop-shaped part being shifted, by a predetermined distance (e.g., several millimeters), from the specified position in the transport direction of the batch of paper sheets W1 held on the loop-shaped part. In this case, the predetermined distance may be an appropriate absolute value, or otherwise may be a proper distance obtained at a predetermined ratio relative to the whole length in the transport direction of the paper sheet (or paper sheets).

The invention claimed is:

1. A paper sheet handling mechanism, comprising:

a transport path having a loop-shaped part provided in a middle part thereof, a downstream side including at least the loop-shaped part of the transport path being capable of transporting a plurality of paper sheets;

a driving unit configured to move the paper sheets along the transport path, such that the paper sheets, respectively present on an upstream side relative to the loop-shaped part as well as on the loop shaped part, can be transported, independently of or in synchronism with, one another;

a paper sheet length detector provided to the loop-shaped part or the upstream side relative to the loop-shaped part along the transport path and configured to detect whether or not a length in a transport direction of the paper sheet fed to the loop-shaped part from the upstream side relative to the loop-shaped part along the transport path is longer than a predetermined length; and a control unit configured to control the driving unit to move each of the paper sheets present on the upstream side relative to the loop-shaped part and one paper sheet or a batch of paper sheets present on the loop-shaped part, such that once the paper sheet present on the upstream side relative to the loop-shaped part is fed to the loop-shaped part, the paper sheet present on the upstream side relative to the loop-shaped part can be stacked with the one paper sheet or the batch of paper sheets circulated along the loop-shaped part, wherein when the paper sheet length detector detects that the length in the transport direction of the paper sheet fed to the loop-shaped part from the upstream side relative to the loop-shaped part is longer than the predetermined length, such a detected paper sheet and the one paper sheet or batch of paper sheets held on the loop-shaped part will be simultaneously ejected from the loop-shaped part.

2. The paper sheet handling mechanism according to claim 1, wherein the paper sheet length detector includes an upstream-side paper sheet detector provided at a point on the upstream side relative to the loop-shaped part along the transport path, and a downstream-side paper sheet detector provided on the downstream side relative to the upstream-side paper sheet detector, at a point in the loop-shaped part or on the upstream side relative to the loop-shaped part along the transport path, the upstream-side paper sheet detector being spaced apart from the downstream-side paper sheet detector, by a distance corresponding to the predetermined length, and wherein when the paper sheet is simultaneously detected by both the upstream-side paper sheet detector and downstream-side paper sheet detector along the transport path, the length in the transport direction of the paper sheet will be judged to be longer than the predetermined length.

3. The paper sheet handling mechanism according to claim 1, wherein the paper sheet length detector includes an upstream-side paper sheet detector provided at a point on the upstream side relative to the loop-shaped part along the transport path, and a downstream-side paper sheet detector provided on the downstream side relative to the upstream-side paper sheet detector, at a point in the loop-shaped part or on the upstream side relative to the loop-shaped part along the transport path, the upstream-side paper sheet detector being spaced apart from the downstream-side paper sheet detector, by a distance shorter than the predetermined length, and wherein in the case the paper sheet is once detected by both of the upstream-side paper sheet detector and downstream-side paper sheet detector along the transport path, and then the paper sheet is continuously detected by the upstream-side paper sheet detector, even after the paper sheet is transported by a predetermined distance, the length in the transport direction of this paper sheet will be judged to be longer than the predetermined length.

4. The paper sheet handling mechanism according to claim 1, wherein the paper sheet length detector includes a paper sheet detector provided at a point on the upstream side relative to the loop-shaped part along the transport path, wherein when the paper sheet detector detects each of the leading end and rear end of the paper sheet to be fed to the loop-shaped part from the upstream side relative to the loop-shaped part along the transport path, the length in the transport direction of this paper can be detected, and wherein if such a detected length is longer than the predetermined length, the length in the transport direction of this paper sheet will be judged to be longer than the predetermined length.

5. The paper sheet handling mechanism according to claim 1, wherein the paper sheet length detector includes a paper sheet detector provided at a point on the upstream side relative to the loop-shaped part along the transport path, and wherein in the case the leading end of the paper sheet to be fed to the loop-shaped part from the upstream side relative to the loop-shaped part along the transport path is once detected by the paper sheet detector, and then the paper sheet is continuously detected by the paper sheet detector, even after the paper sheet is transported by the predetermined length, the length in the transport direction of this paper sheet will be judged to be longer than the predetermined length.

6. A method for handling paper sheets, comprising the steps of:

transporting the paper sheets, successively one by one, at a point on an upstream side relative to a loop-shaped part along a transport path;

detecting whether or not a length in a transport direction of the paper sheet fed to the loop-shaped part from the upstream side relative to the loop-shaped part along the transport path is longer than a predetermined length;

holding the paper sheets by circulating the paper sheets on the loop-shaped part of the transport path, in a batch form; and ejecting the paper sheets which are stacked in the batch form and circulated on the loop-shaped part, wherein once the paper sheet present on the upstream side relative to the loop-shaped part is fed to the loop-shaped part, the paper sheet present on the upstream side relative to the loop-shaped part and one paper sheet or a batch of paper sheets present on the loop-shaped part are respectively moved, such that the paper sheet present on the upstream side relative to the loop-shaped part can be stacked with the one paper sheet or the batch of paper sheets circulated along the loop-shaped part, and wherein when the length in the transport direction of the paper sheet fed to the loop-shaped part from the upstream side relative to the loop-shaped part is detected to be longer than the predetermined length, such a detected paper sheet and the one paper sheet or batch of paper sheets held on the loop-shaped part will be simultaneously ejected from the loop-shaped part.

* * * * *